US008388499B1

(12) United States Patent
Rindfleisch

(10) Patent No.: US 8,388,499 B1
(45) Date of Patent: Mar. 5, 2013

(54) USER CONTROLLED EXERCISE MACHINE

(75) Inventor: Randy R. Rindfleisch, Sheboygan, WI (US)

(73) Assignee: Crazy Train, LLC, Austin, TX (US)

( * ) Notice: Subject to any disclaimer, the term of this patent is extended or adjusted under 35 U.S.C. 154(b) by 0 days.

(21) Appl. No.: 13/360,684

(22) Filed: Jan. 28, 2012

Related U.S. Application Data

(63) Continuation-in-part of application No. 12/495,463, filed on Jun. 30, 2009, now Pat. No. 8,105,206.

(60) Provisional application No. 61/571,639, filed on Jul. 1, 2011.

(51) Int. Cl.
*A63B 71/00* (2006.01)

(52) U.S. Cl. ..... 482/6; 482/1; 482/8; 482/9; 482/51

(58) Field of Classification Search ..... 482/1–9, 482/51, 52, 91, 131, 142, 900–902
See application file for complete search history.

(56) References Cited

U.S. PATENT DOCUMENTS

| | | | | |
|---|---|---|---|---|
| 4,826,155 | A | 5/1989 | James | |
| 5,050,873 | A | 9/1991 | Jones | |
| D321,391 | S | 11/1991 | Jones | |
| 5,066,003 | A | 11/1991 | Jones | |
| 5,125,881 | A | 6/1992 | Jones | |
| 5,135,449 | A | 8/1992 | Jones | |
| 5,135,456 | A | 8/1992 | Jones | |
| 5,171,198 | A | 12/1992 | Jones | |
| 5,180,354 | A | 1/1993 | Jones | |
| 5,181,896 | A | 1/1993 | Jones | |
| 5,273,504 | A | 12/1993 | Jones | |
| 5,273,505 | A | 12/1993 | Jones | |
| 5,827,154 | A * | 10/1998 | Gill | 482/9 |
| 7,029,427 | B2 | 4/2006 | Vuurmans et al. | |
| 7,070,543 | B1 | 7/2006 | Rindfleisch | |
| 7,070,544 | B1 | 7/2006 | Rindfleisch | |
| 7,854,685 | B2 * | 12/2010 | Cole et al. | 482/5 |
| 7,892,159 | B2 * | 2/2011 | McVay et al. | 482/142 |
| 7,967,728 | B2 * | 6/2011 | Zavadsky et al. | 482/5 |
| 7,981,015 | B2 * | 7/2011 | Reed | 482/131 |
| 2006/0046911 | A1 * | 3/2006 | Leight | 482/91 |
| 2010/0227739 | A1 * | 9/2010 | Cunningham | 482/52 |

FOREIGN PATENT DOCUMENTS

| | | |
|---|---|---|
| WO | WO 89/01805 | 3/1989 |

OTHER PUBLICATIONS

Powertec Fitness, website printout of workbench showing leverage bench press. http://www.powertecfitness.com/p-12-workbench-multi-system-wb/ms11.aspx. Printed on Oct. 30, 2012. Publication date unknown.

* cited by examiner

*Primary Examiner* — Glenn Richman
(74) *Attorney, Agent, or Firm* — Brannen Law Office, LLC

(57) ABSTRACT

A dual compound and isolated exercise machine includes a frame including a first portion and a second portion positioned in a plane generally perpendicular to the first portion. The spool line may be relocated to any leverage point on or near the frame. The spool assembly can be wirelessly controlled. Wireless signal sent to a wireless receiver activates a motor, gear reduction box, and variable speed drive to join the spool assembly, causing the release or retraction of the spool line. Tension along the spool line is measured by a force transducer and converted to readable real time measurements for display on a data monitor. The device is capable of producing and measuring maximum (0 to 100%) potential muscle concentric, isometric and concentric muscle contractions. The device is collapsible, portable and wheel chair and paraplegic accessible.

18 Claims, 26 Drawing Sheets

USER CONTROLLED EXERCISE MACHINE

This application is a continuation in part application of pending United States patent application filed on Jun. 30, 2009 and having application Ser. No. 12/495,463, the entire contents of which are hereby incorporated herein by reference, and also claims priority on and the benefit of provisional application 61/571,639 filed Jul. 1, 2011, the entire contents of which are hereby incorporated herein by reference.

BACKGROUND OF THE INVENTION

1. Field of the Invention

The present invention relates generally to exercise and rehabilitation machines. More particularly, the invention relates to a self-adjusting apparatus that is capable of producing and measuring 0-100% of maximum voluntary eccentric, concentric, and static muscular contractions of an individual while exercising or rehabilitating.

2. Description of the Related Art

Various exercise machines have been developed to exercise certain types of human body muscles. These machines are categorized into two broad groups: 1) compound machines which exercise multiple pairs of muscles at the same time and 2) isolation machines which exercise only one pair of muscles at a time. In either case the actual exercise occurs with the movement and contraction of the muscles against an opposing force. The effectiveness of the machine in meeting the specific needs of the user will depend on the quality of interaction between the machine and its user.

The human body muscle is capable of three distinct types of contractions. The first is a positive or concentric function in which the muscle contracts under a load that is less than the muscle strength. The second is a static or isometric function in which the muscle attempts to contract against a load that is greater than the muscle strength. The third is a negative or eccentric function in which an external load is large enough to overcome the muscle strength and force the muscle to elongate in spite of an attempt by the person to contract the muscle.

It is well known that the muscles perform much more efficiently during eccentric functions than during concentric or isometric functions. This is because the same muscle is capable of exerting greater force during its eccentric function than it can during either concentric or isometric functions. Further, concentric and isometric functions results in a comparatively greater expense of energy and stress to the nervous system than eccentric functions, resulting in greater stress to the overall body for the same work out. For this reason, eccentric contraction exercises are preferable from a rehabilitative stance since it produces the much desired benefits of strength building and injury prevention at a much lower metabolic cost with less demand on the cardiovascular and pulmonary systems of the body.

Various types of muscle strengthening equipment have been developed over the years but few take advantage of the varying efficiencies in muscle physiology during motion. These include simple conventional barbells to prohibitively expensive hydraulics. These machines are generally limited to one particular muscle, requiring the purchase of a complete line of machines, which can be very expensive and can occupy a large amount of space. The inconvenience from the lack of versatility in the foregoing machines is experienced at a greater level by physically disabled users, their therapists and trainers. The current rehabilitation equipment available for physically disabled users, particularly those who are wheel chair bound, often require additional handling assistance and do not permit autonomy of use. The difficulty of handling by disabled users often leads to injury, feelings of dependence and frustration which leads to depression.

With few exceptions, prior art exercise and rehabilitation machines continue to be cost prohibitive, non-versatile and fail to maximize on the user's potential workout by exploring the full range muscle functions discussed above. An improvement on these combinations of features would be ideal.

Almost all known prior machines impose a single load that the person must overcome during both concentric and eccentric muscle functions. A few machines are capable of imposing different loads for concentric and eccentric muscle functions, but those machines invariably include very expensive and complicated hydraulic systems.

Examples of prior mechanical exercise machines are plentiful. The Nautilus Co., among others, employ the use of spiral cams in their machines to accommodate the force curves that take place as muscles lengthen and leverage changes occurring during a concentric contraction. However, these machines do not address the difference in performance between concentric, static and eccentric contractions.

Other commercially available exercise machines utilize guided sliding weight stacks. In these machines, the weight can only be changed in between exercise repetitions but not during. Many other styles of commercial exercise machines such as lever based weight machines and plate-loaded machines suffer the same problem in that the inability to manipulate weights during exercise repetitions prohibits the machine from taking advantage of the user's full work out potential as it relates to the various muscle functions.

Examples of lever based machines include the standard bench press, as ones marketed by the Powertec Direct Company. Somewhat similar equipment is shown in PCT patent WO89/01805. Other examples of beam and weight type exercising machines may be seen in U.S. Pat. Nos. 5,050,873; 5,066,003; 5,125,881; 5,135,449; 5,135,456; 5,171,198; 5,180,354; 5,181,896; 5,273,504; 5,273,505; and Des 321, 391. No machine of the foregoing patents gives any indication that different loads should be overcome by the user during concentric and eccentric functions.

U.S. Pat. No. 4,826,155 shows equipment that takes into account the inherent ability of human muscles to perform differently during concentric and eccentric functions. This patent shows a harness worn by the user that is tied with a rope through a block and tackle to assist the user in raising weights during concentric muscle functions. During eccentric muscle functions, a spotter allows an increased load to be imposed on the user.

My earlier patent, U.S. Pat. No. 7,070,543, is a recent invention which does attempt to maximize on the benefits between concentric, isometric and eccentric contractions. The device is a compound weight machine with leverage arms pivoted to a frame. A small force is applied while the lever is in a raised position, imposing an additional load that the user must resist during the eccentric muscle function. The manipulation of weights during each repetition allows the user to maximize his potential concentric and eccentric exertion potential. However, since the variation in load is based on preset weights, it is difficult to measure gradual real time changes in the user's voluntary muscle contraction during exercise. Further, the machine is not self adjustable because it requires assistance of a second party spotter to apply additional loads during repetitions to accomplish the intentions of the machine.

The counterpart to the above referenced compound exercise machine is an isolated exercise machine, U.S. Pat. No. 7,070,544, which maximizes the benefits between concentric, isometric and eccentric contractions. The device comprises a bench style work station with a leverage arm that rotates in unison with one or the other of two force stations. A spotter applies a small force to the leverage arm in its raised position, creating an amplified force against the working muscles during eccentric contractions. As with its counterpart in the above referenced patent, this invention functions manually and is not self-adjusting. Similarly, changes in performance during exercise are limited by the preset loads of the weights. The inability to achieve more accurate real time measurements limits the ability of physical trainers and therapists to control their client's rehabilitation process.

None of the above-patents show a user adjustable machine that is controlled by the user.

Further, none show a machine that has a drive assembly that is controlled at the handle by the user.

Still further, none show a machine that has a drive assembly that is wirelessly controlled by the user.

Still further yet, none show a spool that selectably winds and unwinds.

Still further yet, none show a spool that can utilize a variable amount of force as adjusted by the user during an exercise.

Still further yet, none show a dual or compound drive assembly that is selectably adjustable between a vertical frame and a horizontal frame.

Still further yet, none show a frame having guide posts that allow the user to select from multiple exercises based on use of either the vertical or horizontal frame.

Still further yet, none show a force transducer and converter that converts to standard units to provide real-time feedback to the user.

Still further yet, none show a machine that is adapted for removal of the seat assembly for use with a wheel chair.

Thus there exists a need for a user controlled exercise machine that solves these and other problems.

SUMMARY OF THE INVENTION

In one embodiment an exercise machine includes a frame including a first portion and a second portion positioned in a plane generally perpendicular to the first portion. A carriage assembly moves along a linear path parallel to the first portion. A drive unit is joined to the frame for movement the carriage assembly in a first direction and a second direction. The drive unit includes a motor, a ball screw joined to the motor, and at least one support bearing rotatably joined to the ball screw and joined to the carriage assembly for enabling the carriage to move along the linear path in response to the ball screw rotating. A first sensor activates the motor in a first mode to move the carriage in the first direction. A second sensor activates the motor in a second mode to move the carriage in the second direction. Another embodiment further includes a monitor unit including a display device joined to the frame for at least monitoring the first mode and the second mode of the motor. Yet another embodiment further includes a load cell joined to the frame and drive unit for indicating a resisting force to the carriage movement and transmitting the indication to the monitor unit for display. In another embodiment the monitor unit further includes means for adjusting the first mode and the second mode to control a speed of the movement of the carriage. In yet another embodiment the at least one support bearing further includes a ball nut for rotatably joining to the ball screw. Still other embodiments further include at least one linear rail for guiding the carriage along the linear path and at least one pillow block bearing joined to the carriage for travel along the linear rail. In another embodiment the exercise machine is wheelchair and paraplegic accessible. In yet another embodiment the first portion is oriented generally horizontally. In still another embodiment the first portion is oriented generally vertically.

In another embodiment an exercise machine includes a frame including a first portion and a second portion positioned in a plane generally perpendicular to the first portion. A carriage assembly moves along a linear path parallel to the first portion. The exercise machine further includes means for moving the carriage assembly in a first direction and a second direction along the linear path, means for activating the moving means in a first mode to move the carriage in the first direction and means for activating the moving means in a second mode to move the carriage in the second direction. Another embodiment further includes means for monitoring the first mode and the second mode of the motor. Yet another embodiment further includes means for indicating a resisting force to the carriage movement and transmitting the indication to the monitoring means. Still another embodiment further includes means for adjusting the first mode and the second mode to control a speed of the movement of the carriage. Yet another embodiment further includes means for guiding the carriage along the linear path.

In another embodiment an exercise machine includes a frame including a first portion, a second portion positioned in a plane generally perpendicular to the first portion, and linear rails parallel to the first portion. A carriage assembly moves along the linear rails. Pillow block bearings are joined to the carriage for travel along the linear rails. A drive unit is joined to the frame for movement the carriage assembly in a first direction and a second direction. The drive unit includes a motor, a ball screw joined to the motor, and at least one support bearing including a ball nut for rotatably joining to the ball screw. The support bearing is joined to the carriage assembly for enabling the carriage to move along the linear rails in response to the ball screw rotating. A first sensor activates the motor in a first mode to move the carriage in the first direction. A second sensor activates the motor in a second mode to move the carriage in the second direction. A monitor unit, including a display device joined to the frame, at least monitors the first mode and the second mode of the motor. The monitor unit includes means for adjusting the first mode and the second mode to control a speed of the movement of the carriage. A load cell is joined to the frame and the drive unit for indicating a resisting force to the carriage movement and for transmitting the indication to the monitor unit for display on the display device. In another embodiment the motor includes a gear reduction box. In yet another embodiment the exercise machine is wheelchair and paraplegic accessible. In still another embodiment the first portion is oriented generally horizontally. In yet another embodiment the first portion is oriented generally vertically.

In accordance with yet another embodiment of the present invention, a dual compound and isolated exercise machine is provided to which the user may independently vary loads (from 0 to 100% of maximum voluntary contraction) on a gradual basis during concentric, isometric and eccentric muscle functions; measure performance on a real time basis; self adjust the machine to accommodate a variety of exercise choices; and is portable, storable and accessible for wheel chairs and paraplegic users.

In any exercise repetition, the user will exert a full range of muscle contractions (concentric, isometric and eccentric contractions). Since the human muscle is able to exert the greatest force during eccentric contraction, the amount of tension set for the user's maximum (100%) potential concentric contract will not meet the user's maximum eccentric contraction potential. To maximize on all three muscle contraction potentials, the machine needs to be able to add greater tension against the exercising muscle during the eccentric contraction and decrease the load or weight to meet the muscle's maximum force potential during the isometric and concentric contractions. This is achieved in the current invention by allowing the user to change the opposing load of the machine at any time, but particularly in the middle of exercise repetitions. The improved unique feature that allows for this capability is found in the spool assembly and wireless control features which enables the user to easily and quickly manipulate the opposing tension of the machine on their own during exercise. The nature of the spool assembly further allows the user to tailor the machine to any variety of exercise choices, creating a versatile self-operating all-in-one exercise machine capable of extracting maximum (0 to 100%) potential concentric, isometric and eccentric contractions.

The spool feature comprises a spool assembly wounded with a spool line which may be composed of any stretch resistant material such as but not limited to metal round wire, nylon strap, polypropylene strap, etc. The spool line may comprise one continuous stretch of material, a linear series of interconnected pieces, or a single central spool line emanating from the spool assembling connecting to one or more separate lines at its ends for multiple or single carriage exercises (the carriage essentially comprising handles or belt attachment in contact with the user). In any case, the preferred embodiment of this device will have one central spool assembly to maintain consistent speed of release and retraction of the spool line, whether single or multiple carriages are being used during exercises. The spool assembly is capable of rotating, thereby releasing or retracting the spool line. The rotation and speed of rotation of the spool line on the spool assembly can be accomplished with a simple electrical motor and speed reduction gear or any device and method capable of achieving the same or equivalent result. The speed of release and retraction of the spool line can be varied, ultimately adjusting the tension of the spool line against the user and adjusting the quickness of each exercise repetition. In the current preferred embodiment, the speed of release is set at a range safe enough for the standard user and may be manually adjusted at smaller or greater ranges. An alternate embodiment of this device may take greater advantage of the speed of release in the spool line, allowing for automatic adjustments of the spool assembly during or between exercise repetitions by any applicable means. The maximum opposing force exerted from the spool assembly is preferably greater than the maximum force potential of any individual user in the market so as to guarantee the machine's ability to meet and measure the maximum force potential of users in the market. In the preferred embodiment, the maximum opposing force of the machine is set at one horse power.

The release or retraction of the spool line from the spool assembly is controlled directly by the user. In the current preferred embodiment, this is achieved by a wireless control device with simple electronic switches wirelessly connected to motor device which controls the direction of rotation of the spool assembly. In the preferred embodiment, the wireless control device is embedded within a right and a left handle wherein the control device is activated by button switches. One handle controls the retraction of the spool line while the other handle controls the release of the spool line. Note that this is only one of many possible embodiments of the wireless sensor control. The method of controlling the release and retraction of the spool line need not be embodied in a hand held system nor does the release and retraction of the spool line require separate controls. The simple action of release and retraction of the spool line may be achieved by one or more control devices and by other applicable means such as but not limited to voice and sound recognition, computer automation, wire connection, manual adjustments, etc. In the current embodiment, the wireless control is attached to exercise handles to allow the user to grasp, pull and adjust the spool line in a single motion. Alternate embodiments of the remote control and the machine may have the control located at different convenient locations on or near the exercise machine.

The frame of the exercise machine in this invention provides for a horizontal and vertical portion centrally connected and perpendicular to each other. Guide posts are positioned at various locations along the horizontal and vertical portions of the frame. The guide post provides a leverage point between the user and the spool assembly during exercise and defines the type of exercise attempted. The spool line is looped through the guide post and is able to slide back and forth between the guidepost during exercise. In the preferred embodiment, the guidepost comprises a small opening in the frame with an attached rod to allow for smooth movements by the spool line. Alternate embodiments of the guidepost may utilize other applicable features that allow the spool line to loop through and be leveraged from the guidepost position, such as a simple hole in the frame, attached rings or attachable and detachable slits, etc.

In the current preferred embodiment, the spool assembly is attached to the vertical portion of the frame at the bottom corner angle where the two frame portions meet. However, it should be apparent to those ordinarily skilled in the art that the location of placement of the spool assembly may not be limited to the bottom portions of the frame. The spool line is released from the spool assembly and threaded through the guide post along either vertical or horizontal portions of the frame. Guideposts may also be provided elsewhere besides the frame of the machine as for example, on attachments including but not limited to the seat assembly, the foot plate, a wheel chair receiver and stabilizer, etc. A carriage (essentially handles or a belt attachment) is attached to the end of the spool line at the opposite end of the spool assembly that will be in contact with the user. In the preferred embodiment, a wireless sensor is attached to both right and left handle attachments with button controls for the release and retraction of the spool line. The choice of guidepost location with which the spool line is threaded through defines the type of muscle exercise the user will be implementing. A user may manually rethread the spool line through any guidepost on the machine with minimal effort. In the preferred embodiment, the user would detach the spool line from the carriage, rethread the spool line through another chosen guidepost and reattach the spool line with the carriage for the preferred type of exercise. This specific feature which allows the spool line to be relocated on the machine creates an all-in-one isolation and compound exercise machine that is space minimal and versatile. Further, the spool based aspect of this invention allows for free range of motion during exercise, enabling the user to exercise a greater variety and combination of muscles in contrast to its predecessors. The frame may be collapsible for purposes of minimal storage and easy transport. The simple structure of the L shaped frame also makes it wheel chair adaptable. By detaching the seat assembly from the main frame, a wheel chair may be rolled in the seat assembly's place and be locked in for exercise.

A force transducer is attached near the rotating spool assembly for purposes of measuring real time changes in the tension created between the user and the spool line during exercise. The measured force within the force transducer is forwarded to a signal converter where the information is translated into standardized units. The signal converter may or may not include an attached digital display but is capable of transferring information to the user's digital devices (any variety of personal computers or handheld digital systems) by USB cable or wirelessly as by blue tooth. The force transducer and signal converter is capable of measuring separate performances during concentric, isometric or eccentric contractions or some combination of the various types of performances. In the current preferred embodiment, signal converter is encased together with the wireless signal receiver which is attached to the lower bottom corner of the machine. However, this signal transmission box may be attached at any location near or along the frame and is capable of additional control features. Alternatively, the signal transmission box may include additional control features such as means for controlling and adjusting the speed of release and retraction of the spool line. In any particular embodiment of this invention, the signal converter should be able to measure the user's real time total combined concentric, isometric and eccentric performances. In any particular embodiment of this invention, the signal converter is capable of transferring data to an external hard drive by any current technological means. In the current preferred embodiment, transfer of data is accomplished by USB connection to a computer device that is preloaded with a tailored software program.

Alternate embodiments of this invention may include without limitation any variety of the following accessories: a detachable seat assembly attached to the horizontal portion of the frame to support upper body exercises, a foot plate attached to the horizontal portion of the frame to support lower body exercises, detachable handle and waist strap carriages to accommodate the choice of exercise, or a wheel chair receiver and stabilizer in place of the seat assembly on the horizontal portion.

In typical use of the present invention, the user is positioned appropriately either on the seat or against the foot plate. The user contacts the carriages, footplate, or seat with the appropriate part of the body and activates the rotation of the spool line by the wireless sensor. The user exerts force with the appropriate muscles in a concentric contraction until the desired measure of performance has been achieved. At the end of the concentric contraction the user activates the wireless sensor causing the spool line to retract which also imposes an additional opposing force on the line. The user exerts force with the same muscles in an eccentric contraction until the desired measure of performance has been achieved. The user then repeats this cycle for as many repetitions as desired. The amount of power generated by the electric motor would far exceed the user's force generating ability, thus guaranteeing every user's ability to exert his or her full potential force if so desired.

All embodiments of the invention are adaptable to exercising virtually all muscles of the body. The vertical portion of the frame enables a person to perform exercises including, but not limited to, pull-downs, triceps push-downs, curls, abdominal crunches, pectoral cross-overs, rows, etc. The horizontal portion of the frame enables the user to perform exercises including, but not limited to squats, dead-lifts, stiff legged dead-lifts, calf raises, bench presses (flat, incline, and decline), dips, military presses, rows, shrugs, crunches, lateral raises, etc.)

Other features, advantages, and object of the present invention will become more apparent and be more readily understood from the following detailed description, which should be read in conjunction with the accompanying drawings.

BRIEF DESCRIPTION OF THE DRAWINGS

FIG. 2A shows the user at the start of a concentric contraction or at the end of an eccentric contraction, and FIG. 2B shows the user at the end of the concentric contraction or at the start of the eccentric contraction.

FIG. 3A shows the user at the start of a concentric contraction or at the end of an eccentric contraction, and FIG. 3B shows the user at the end of the concentric contraction or at the start of the eccentric contraction.

FIG. 5A shows the user at the start of a concentric contraction or at the end of an eccentric contraction, and FIG. 5B shows the user at the end of the concentric contraction or at the start of the eccentric contraction.

FIG. 6A shows the user at the start of a concentric contraction or at the end of an eccentric contraction, and FIG. 6B shows the user at the end of the concentric contraction or at the start of the eccentric contraction.

FIG. 14A shows the user at the start of a concentric contraction or at the end of an eccentric contraction, and FIG. 14B shows the user at the end of a concentric contraction or at the start of an eccentric contraction.

FIG. 15A shows the user at the start of a concentric contraction or at the end of an eccentric contraction, and FIG. 15B shows the user at the end of a concentric contraction or at the start of an eccentric contraction.

FIG. 16A shows the user at the start of a concentric contraction or at the end of an eccentric contraction, and FIG. 16B shows the user at the end of a concentric contraction or at the start of an eccentric contraction.

FIG. 17A shows the user at the start of a concentric contraction or at the end of an eccentric contraction, and FIG. 17B shows the user at the end of a concentric contraction or at the start of an eccentric contraction.

FIG. 18A shows the user at the start of a concentric contraction or at the end of an eccentric contraction, and FIG. 18B shows the user at the end of a concentric contraction or at the start of an eccentric contraction.

DETAILED DESCRIPTION OF THE PREFERRED EMBODIMENTS

Figure 1:
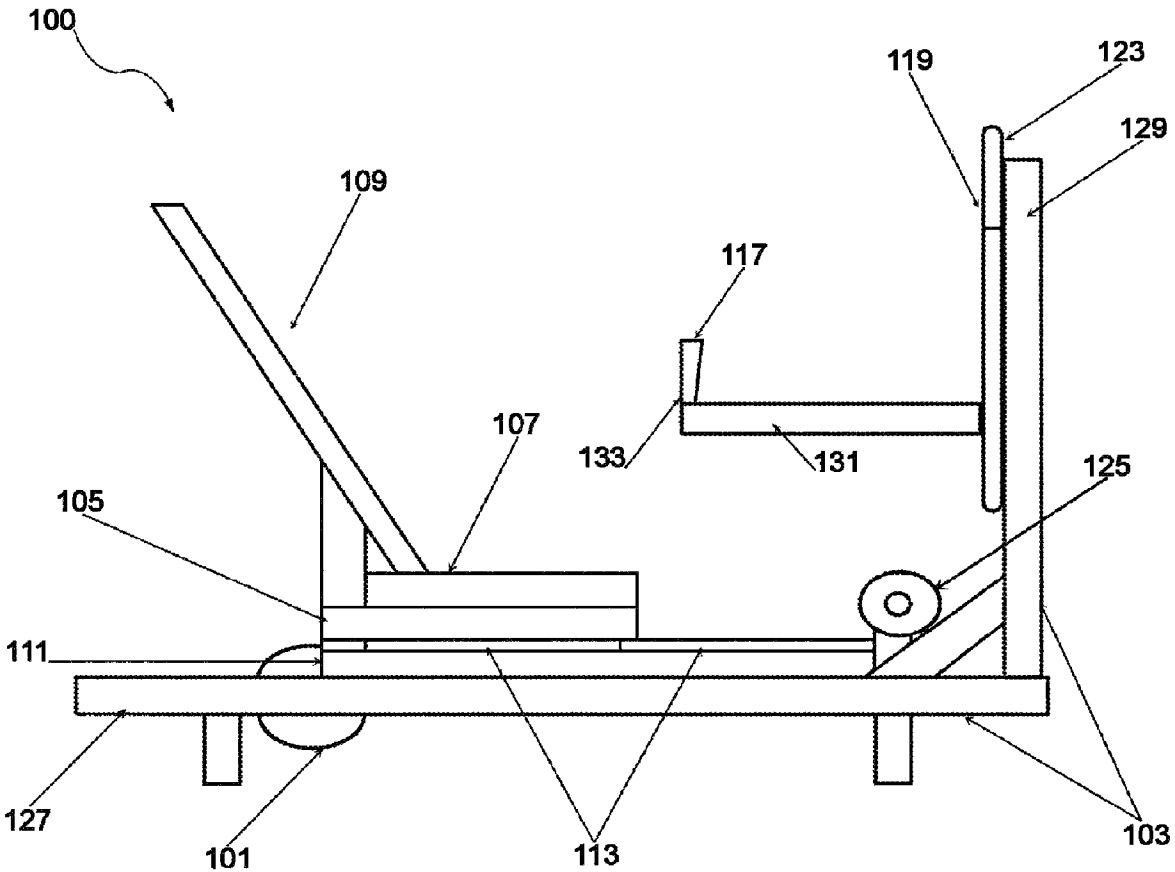
FIG. 1 is a diagrammatic side view of an exemplary exercise or rehabilitation machine with a horizontal carriage configuration, in accordance with an embodiment of the present invention.

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The present invention will now be described in detail with reference to embodiments thereof as illustrated in the accompanying drawings.

Detailed descriptions of the preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

Preferred embodiments of the present invention provide exercise or rehabilitation machines that enable a user to produce 0-100% of their potential force while performing concentric, eccentric and static muscular contractions. Preferred embodiments of the present invention comprise a motor-driven, gearbox-reduced ball screw assembly that enhances the efficiency of muscle strength building or rehabilitation. In preferred embodiments, the motor-driven, gearbox-reduced ball screw travels at a desired adjustable speed, enabling a client or patient to push or pull using the desired muscles in a linear closed kinetic chain fashion at 0-100% of their potential force of concentric, static, and eccentric contractions. Preferred embodiments also comprise a real time force gauge on a touch screen that enables the user to see exactly how much force they are producing throughout the entire range of motion during concentric, static, and eccentric contractions for any given muscle. Patients and clients as well as therapists and trainers will be able to determine in real time if the patient or client is applying the prescribed amount of force desired for that session based on previous static testing on the same machine. As the level of strength and neurological progress increases with the patient or client using a preferred embodiment, the percentage of concentric, static, and eccentric contractions can progress in a safe and comfortable manner until 100% functional ability is achieved.

In preferred embodiments, an exercise or rehabilitation machine comprises a frame that rests on the floor. A hollow shaft, gearbox-reduced electric motor with a variable speed drive is connected to a ball screw assembly which includes a force sensor attached to the other end of the frame by tapered bearings enclosed in housings. In preferred embodiments, the ball screw assembly has either a vertical or horizontal carriage connected to four pillow block bearings that travel either vertically or horizontally along linear rails. Movement either vertically or horizontally is initiated by touchless sensors located on the ends of handles connected to the carriage in a vertical configuration or a footplate in a horizontal configuration. In preferred embodiments, left sensors move the carriage forward in the horizontal configuration or up in the vertical configuration, and right sensors move the carriage backward in the horizontal configuration or down in the vertical configuration. However, the left and right sensors may be reversed in alternate embodiments. In preferred embodiments, limit switches at opposite ends of the linear rails, both vertically and horizontally, prevent the carriage from traveling beyond the desired range of motion. In preferred embodiments, the force sensor and variable drive are connected to a touch screen mounted to the top of the footplate on the horizontal configuration and a vertical post on the vertical configuration. A seat for the exercising or rehabilitating person is attached to the frame in the vertical configuration and attached to the carriage in the horizontal configuration. Preferred embodiments enable the seat, footplate, roller pads, handles, and carriages to be located relative to each other to enable a person to exercise or rehabilitate a particular set of muscles.

In typical use of a preferred embodiment, an exercising person places himself in the appropriate position on the machine's seat and/or footplate. The user contacts the handles, footplate, seat, or carriage with the appropriate part of the body and then activates the carriage, vertically or horizontally, by placing a thumb over the appropriate touchless sensor. The user exerts force with the appropriate muscles in a concentric contraction until the desired range of motion has been achieved. At the end of the concentric contraction the user removes their thumb from the sensor and places a thumb over the opposite sensor to activate the carriage, vertically or horizontally, in the opposite direction. The user exerts force with the same muscles in an eccentric contraction until the desired range of motion has been achieved. The user then repeats this cycle for as many repetitions as desired. The amount of power generated by the electric motor in preferred embodiments far exceeds a user's force generating ability, thus enabling the individual to exert 0-100% of his pre-determined ability in concentric, static, and eccentric contractions generally in safety and comfort. The method and apparatus of preferred embodiments of the present invention, a gearbox-reduced, variable speed driven electric motor and ball screw assembly, greatly increases the efficiency of exercise and rehabilitation sessions. Furthermore, it is generally assumed by some that only healthy, mobile people will be able to exercise or rehabilitate on preferred embodiments of the present invention. However, both vertical and horizontal embodiments are wheelchair and paraplegic accessible.

Preferred embodiments of the present invention are adaptable to exercising virtually all muscles of the body. In a preferred vertical embodiment of the present invention, the machine enables a person to perform exercises including but not limited to the following: squats, dead lifts, calf raises, abdominal crunches, pull-downs, presses, dips, rows, shrugs, etc. In a preferred horizontal embodiment of the present invention, the machine enables a person to perform exercises including, but not limited to, the following: leg presses, leg curls, calf raises, bench presses, rows, abdominal crunches, etc. Vertical and horizontal embodiments of the present invention preferably have the same basic frame and motor, ball screw assembly. In these preferred embodiments, only the movement of the carriage varies between the vertical and the horizontal configurations to suit the particular exercise to be performed. However, in alternate embodiments frames and motor assemblies may be created specifically for a vertical or a horizontal configuration. In both vertical and horizontal embodiments of the present invention, the same laws of physics and physiology apply.

FIG. 1 is a diagrammatic side view of an exemplary exercise or rehabilitation machine 100 with a horizontal carriage configuration, in accordance with an embodiment of the present invention. In the present embodiment, exercise machine 100 comprises a gear-reduced ball screw assembly driven by an electric motor 101. Exercise machine 100 is in a horizontal configuration; however, it will be readily understood by those skilled in the art that alternate embodiments of the present invention are not limited to a horizontal configuration for exercising any specific human muscles. On the contrary, various different embodiments may be useful for exercising a wide variety of muscles.

Exercise machine 100 comprises a frame 103, electric motor 101, the gear-reduced ball screw assembly including support bearing 135, a bearing housing and tapered bearings, a horizontal carriage 105 with a seat 107 and a backrest 109, linear rails 111, pillow blocks 113, front and rear limit switches (not shown), forward and reverse sensors 117, a footplate 119, a load cell (not shown), a force display and speed control touch screen 123, and roller pads 125. In the present embodiment, frame 103 is constructed with two parallel, horizontal metal beams 127 fixed to three cross braces (not shown) and one upright metal beam 129, which is fixed in a perpendicular position to the forward most cross brace. Those skilled in the art, in light of the present teachings, will readily recognize that frames in alternate embodiments may be assembled in a multiplicity of different configurations and may be made of various different materials such as, but not limited to, wood, plastics, composite materials, etc. In the present embodiment, footplate 119 is fixed to upright beam 129 as well as touch screen 123, which is fixed to upright beam 129 above foot plate 119. Two horizontal handles 131 are attached to footplate 119, and a round tube 133 is fixed vertically to each horizontal handle 131. Handles 131 are located on the left and right side of footplate 119 in front of horizontal carriage 105. In some embodiments the tubes may be attached to the horizontal handles in a removable fashion so that users can interchange tubes of different sizes for increased comfort when performing different exercises and to accommodate users with different hand sizes. In the present embodiment, horizontal carriage 105 is attached to four pillow block bearings 113, and pillow block bearings 113 are attached to two linear rails 111. Linear rails 111 are fixed to two horizontal metal beams 127. Horizontal carriage 105 is attached to support bearings 135 which travel upon the command of sensors 117 along the ball screw which is inserted into a gear reduction box which is attached to electric motor 101. Electric motor 101 comprises a variable speed drive and is located on the rear metal cross brace between horizontal beams 127. The ball screw mechanism is attached to two tapered bearings enclosed in a bearing housing which is fixed to the load cell. The load cell is fixed to the forward most metal cross brace between horizontal beams 127. Two limit switches are located at opposite ends of linear rails 111 fixed to the inside of one of horizontal metal beams 127 to automatically stop movement of horizontal carriage 105 when horizontal carriage 105 reaches the limits of the desired range of motion.

In typical use of the present embodiment, a user sits on horizontal carriage 105, places their feet on footplate 119 or roller pads 125, grabs tubes 133 on handles 131, and places a thumb over one of sensors 117. Placing a thumb over a sensor 117 activates the variable speed control which activates electric motor 101 which then causes the ball screw to rotate causing support bearings 135 to travel along the ball screw in a linear fashion. Since horizontal carriage 105 is fixed to pillow blocks 113 that are fixed to linear rails 111, horizontal carriage 105 travels in the direction determined by the sensor on which the user has their thumb, either away from footplate 119 if the reverse sensor is covered or toward footplate 119 if the forward sensor is covered, until the user lifts their thumb off of sensor 117 or horizontal carriage 105 reaches the rear or front limit switch. While horizontal carriage 105 is moving, the user exerts force on footplate 119 and/or pushes or pulls on tubes 133 to perform a concentric muscular contraction or an eccentric muscular contraction depending on the position of the user's body and the direction of the movement of horizontal carriage 105. Touch screen 123 enables the user to see how much force he is exerting throughout the exercise and also enables the user to change the speed of the movement of horizontal carriage 105. In alternate embodiments the force display may not be a touch screen. These embodiments may comprise buttons separate from the force display to control the speed of the horizontal carriage.

Figure 2A:
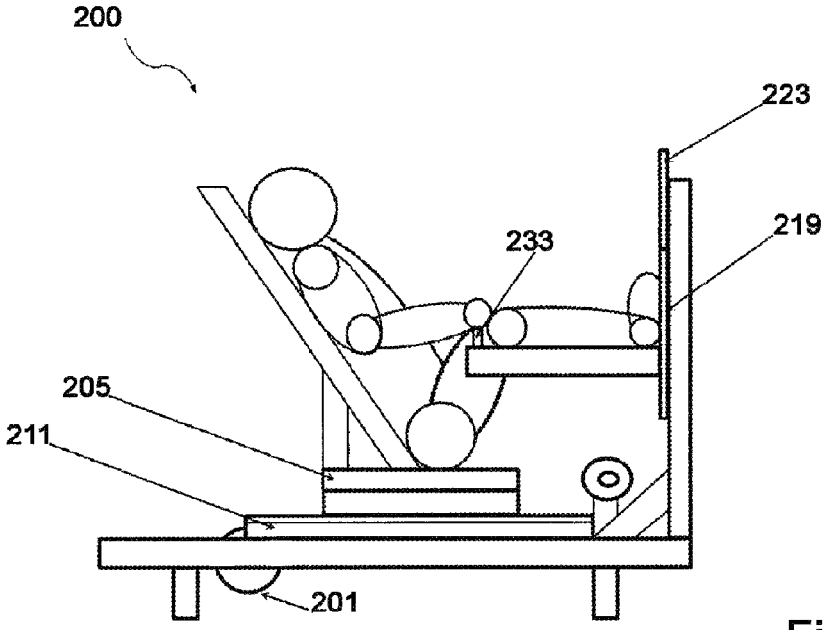
FIGS. 2A and 2B are diagrammatic side views of a user performing a leg press, a bench press or a rowing exercise on an exemplary exercise or rehabilitation machine with a horizontal carriage configuration, in accordance with an embodiment of the present invention.
Figure 2B:
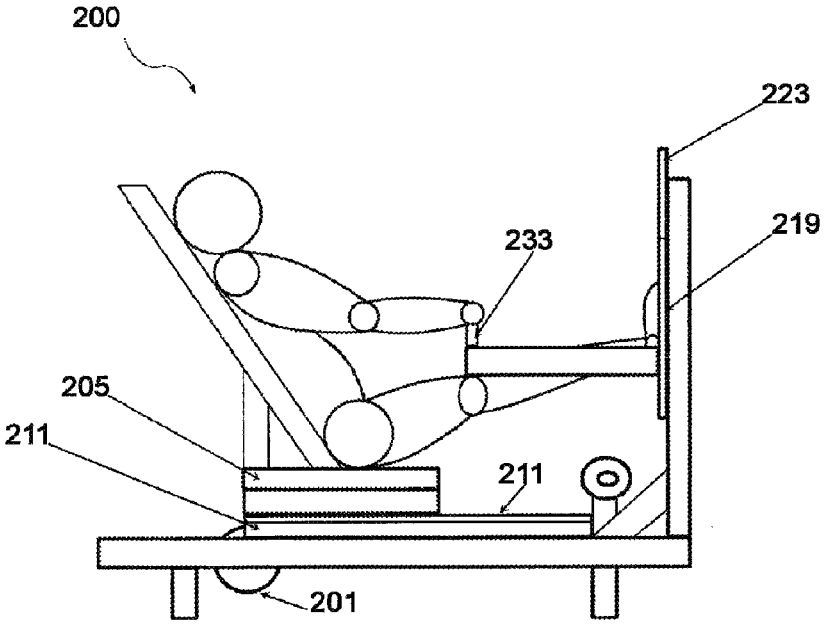

FIGS. 2A and 2B are diagrammatic side views of a user performing a leg press, a bench press or a rowing exercise on an exemplary exercise or rehabilitation machine 200 with a horizontal carriage configuration, in accordance with an embodiment of the present invention. FIG. 2A shows the user at the start of a concentric contraction or at the end of an eccentric contraction, and FIG. 2B shows the user at the end of the concentric contraction or at the start of the eccentric contraction. To perform a leg press, a bench press or a row, the user sits on a horizontal carriage 205, places their feet on a footplate 219 and grabs tubes 233. Placing a thumb over a forward or reverse sensor at tubes 233 activates a variable speed drive which activates an electric motor 201 and a ball screw mechanism coupled to motor 201. This causes horizontal carriage 205 to travel along linear rails 211 in a horizontal motion. Referring to FIG. 2A, for a leg press or bench press, the user exerts force on footplate 219 with his legs while covering the reverse sensor to move horizontal carriage 205 away from footplate 219 to perform a concentric contraction. Then, referring to FIG. 2B, when the user's legs are extended, the user releases the reverse sensor and places a thumb over the forward sensor, which causes horizontal carriage 205 to move towards footplate 219 while the user continues to exert force on footplate 219 with his legs allowing the user to perform an eccentric leg press or bench press. The user may then release the forward sensor and cover the reverse sensor to repeat the concentric contraction. The user can monitor his force production throughout the various stages of the exercise by looking at a force display 223. The actions to perform a rowing exercise are the same as those for performing a leg press or a bench press except that the user pulls or pushes on tubes 133 with his arms, depending on the direction in which horizontal carriage 205 is moving, rather than exerting force on footplate 219 with his legs.

Figure 3A:
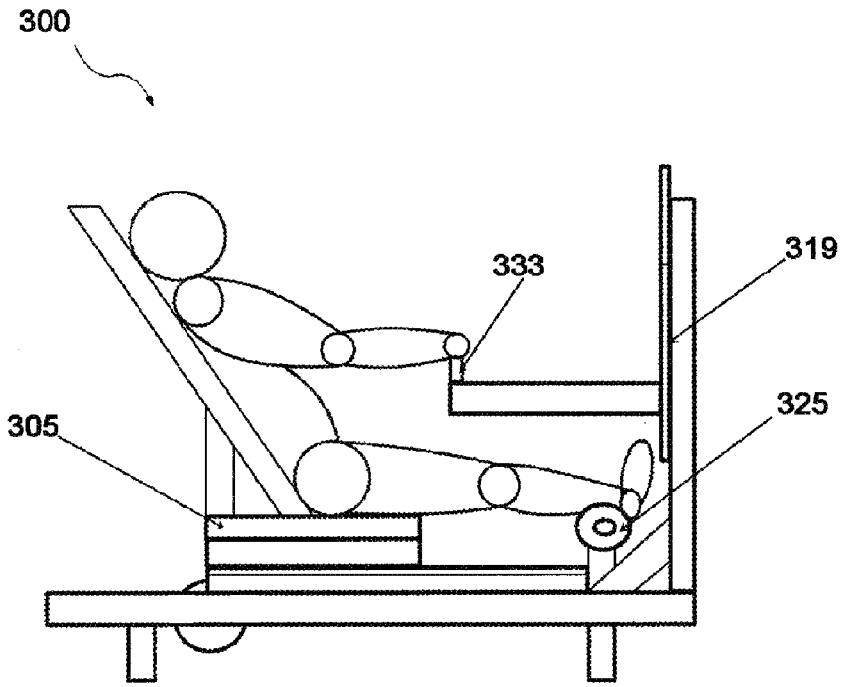
FIGS. 3A and 3B are diagrammatic side views of a user performing a leg curl on an exemplary exercise or rehabilitation machine with a horizontal carriage configuration, in accordance with an embodiment of the present invention.
Figure 3B:
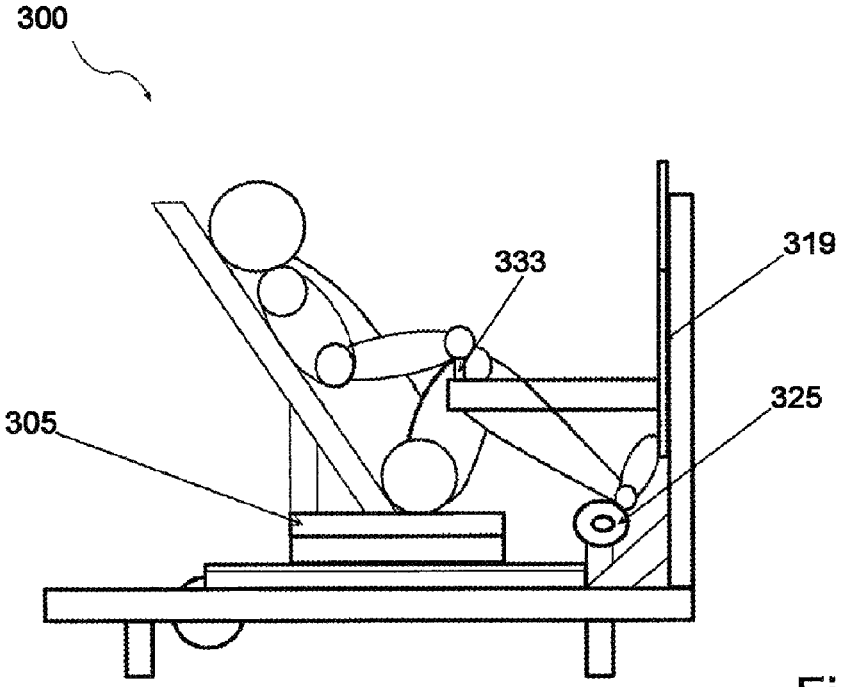

FIGS. 3A and 3B are diagrammatic side views of a user performing a leg curl on an exemplary exercise or rehabilitation machine 300 with a horizontal carriage configuration, in accordance with an embodiment of the present invention. FIG. 3A shows the user at the start of a concentric contraction or at the end of an eccentric contraction, and FIG. 3B shows the user at the end of the concentric contraction or at the start of the eccentric contraction. To perform a leg curl, the user sits on a horizontal carriage 305 and places his heels on roller pads 325. The user then presses his heels into roller pads 325 while controlling the movement of horizontal carriage 305 with forward and reverse sensors at tubes 333. The concentric contraction is performed while horizontal carriage 305 is moving toward a footplate 319, and the eccentric contraction is performed while horizontal carriage 305 is moving away from footplate 319.

Those skilled in the art, in light of the present teachings, will readily recognize that a multiplicity of alternate exercises may be performed on exercise and rehabilitation machines with horizontal carriage configurations in accordance with preferred embodiments of the present invention such as, but not limited to, calf raises, abdominal crunches, etc.

Figure 4:
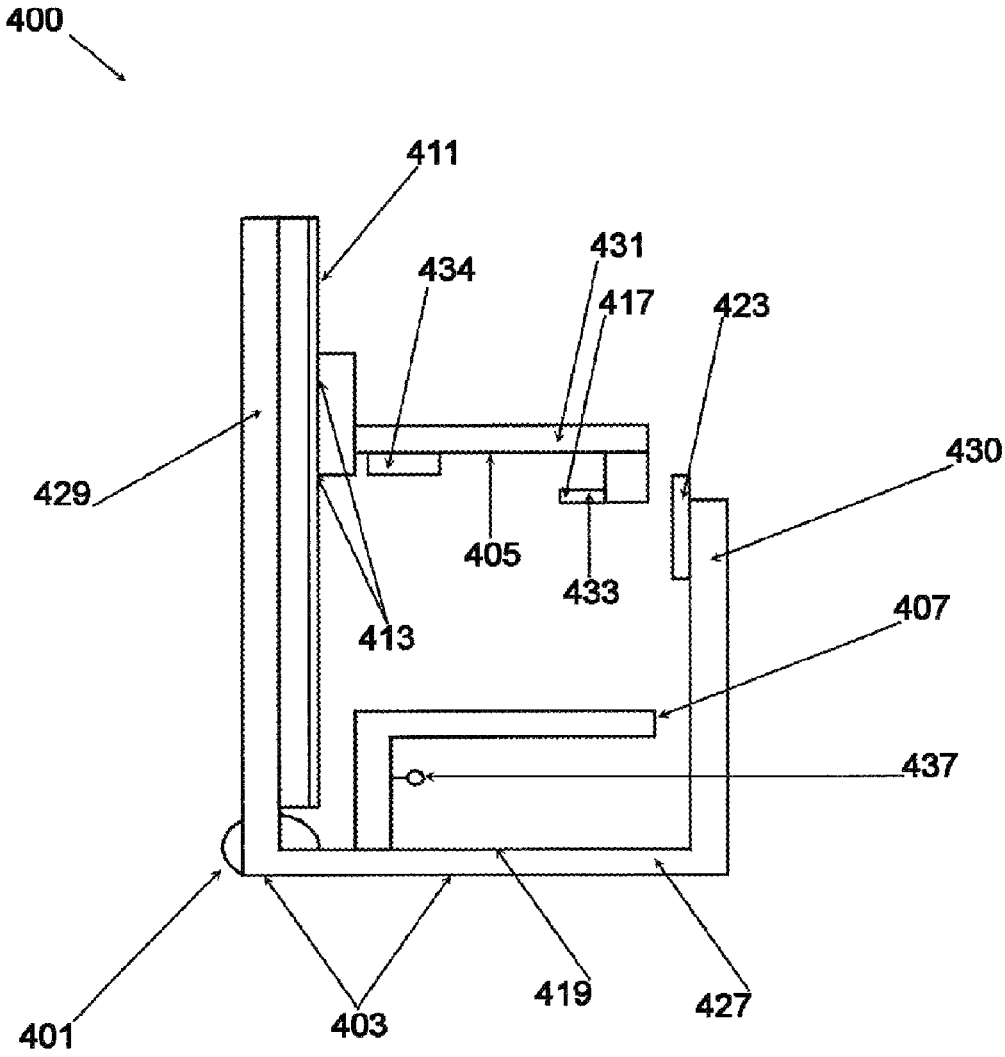
FIG. 4 is a diagrammatic side view of an exemplary exercise or rehabilitation machine with a vertical carriage configuration, in accordance with an embodiment of the present invention.

FIG. 4 is a diagrammatic side view of an exemplary exercise or rehabilitation machine 400 with a vertical carriage configuration, in accordance with an embodiment of the present invention. In the present embodiment, exercise machine 400 comprises a gearbox-reduced ball screw assembly driven by an electric motor 401. Exercise machine 400 is in a vertical configuration; however, it will be understood by those skilled in the art that alternate embodiments of the present are not limited to a vertical configuration for exercising or rehabilitating specific human muscles. On the contrary, various different embodiments of the present invention may be useful for exercising a wide variety of muscles.

Exercise machine 400 comprises a frame 403, electric motor 401, the gearbox-reduced, variable speed drive ball screw assembly including support bearings 435 [, a bearing housing and tapered bearings, Exercise machine 400 also comprises a vertical carriage 405, linear rails 411, pillow blocks 413, top and bottom limit switches (not shown), up and down sensors 417, a footplate 419, a load cell (not shown), a digital force display and speed control touch screen 423, and a vertically adjustable seat 407. In the present embodiment, frame 403 comprises two horizontal metal beams 427 fixed to three cross braces (not shown) and two upright metal beams 429 fixed to one cross brace (not shown) near the top of upright beams 429. Upright beams 429 are fixed to horizontal beams 427 perpendicularly. A vertical metal beam 430 is fixed perpendicularly to the center of the forward most cross brace between horizontal beams 427. Those skilled in the art, in light of the present teachings, will readily recognize that frames in alternate embodiments may be assembled in a multiplicity of different configurations and may be made of various different materials such as, but not limited to, wood, plastics, etc. In the present embodiment, footplate 419 is attached to horizontal beams 427, and touch screen 423 is attached to vertical beam 430. Two horizontal handles 431 are attached to vertical carriage 405, and a round tube 433 is attached to each of horizontal handles 431. Alternate embodiments may comprise a second set of tubes on the upper side of the horizontal handles, as shown by way of example in FIGS. 6A and 6B, to enable the user to perform a wider variety of exercises. In some embodiments the tubes may be attached to the horizontal handles in a removable fashion so that users can interchange tubes of different sizes for increased comfort when performing different exercises and to accommodate users with different hand sizes. In the present embodiment, a shoulder pad 434 is attached to each horizontal handle 431 for user comfort.

Vertical carriage 405 is attached to four pillow block bearings 413, and pillow block bearings 413 are attached to two linear rails 411. Linear rails 411 are fixed to upright beams 429. Vertical carriage 405 is fixed to support bearings 435 which travel upon the command of up and down sensors 417 along the ball screw. The ball screw is inserted into a gear reduction box which is attached to electric motor 401. Electric motor 401 is fixed to a variable speed drive near a bottom rear cross brace. The ball screw is fixed to two tapered bearings enclosed in a bearing housing which is fixed to the load cell. In the present embodiment, the load cell is fixed to the top most cross brace between upright beams 429. Two limit switches are located at opposite ends of linear rails 411 and fixed to the inside of an upright beam 429 to automatically stop movement of vertical carriage 405 when vertical carriage 405 reaches the limits of the desired range of motion. Vertically adjustable seat 407 is fixed to a center cross brace between horizontal beams 427. In the present embodiment seat 407 is vertically adjusted by means of a spring-loaded pin 437. However, the seat in alternate embodiments may be adjusted using various different means such as, but not limited to, a crank, a series of holes into which a pin slides, etc.

In typical use of the present embodiment, a user places their feet on footplate 419 and grabs tubes 433 on handles 431. For some exercises, such as, but not limited to, dips or dead lifts, seat 407 may be removed so that it is not in the way of the movement of the user, and in other exercises such as, but not limited to, pull downs or presses the user sits on seat 407 to correctly perform the exercise. Once the user is in the correct position for the particular exercise, the user places a thumb over one of sensors 417. Placing a thumb over a sensor 417 activates the variable speed control which activates electric motor 401 which then causes the ball screw to rotate causing support bearings 435 to travel along the ball screw in a linear fashion. Since vertical carriage 405 is fixed to pillow blocks 413 that are fixed to linear rails 411, vertical carriage 405 travels along linear rails 411 in the direction determined by the sensor 417 on which the user has their thumb, either up if the up sensor is covered or down if the down sensor is covered, until the user removes their thumb from sensor 417 or vertical carriage 405 reaches the top or bottom limit switch. While vertical carriage 405 is moving, the user exerts force on footplate 419 and/or pushes or pulls on tubes 433 to perform a concentric muscular contraction or an eccentric muscular contraction depending on the position of the user's body and the direction of the movement of vertical carriage 405. Touch screen 423 enables the user to see how much force he is exerting throughout the exercise and also enables the user to change the speed of the movement of vertical carriage 405. In alternate embodiments the force display may not be a touch screen. These embodiments may comprise buttons separate from the force display to control the speed of the vertical carriage.

Figure 5A:
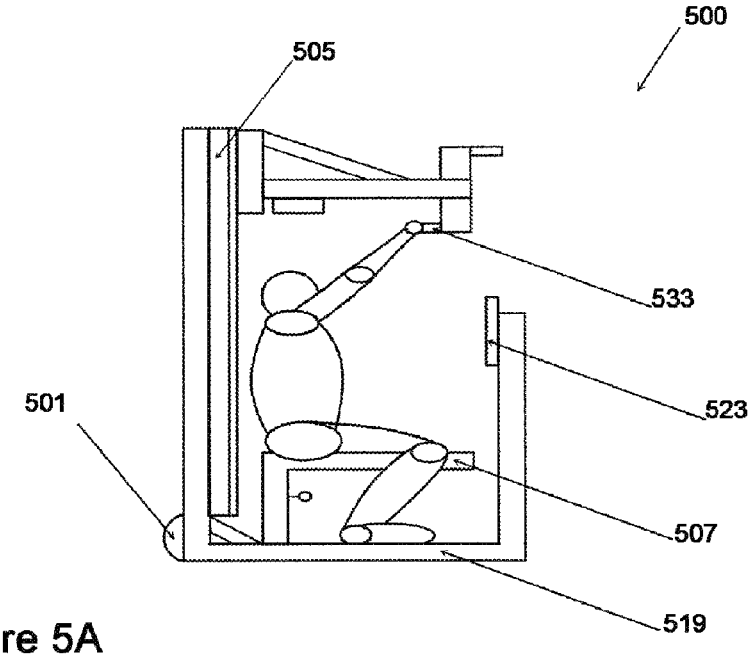
FIGS. 5A and 5B are diagrammatic side views of a user performing a pull-down on an exemplary exercise or rehabilitation machine with a vertical carriage configuration, in accordance with an embodiment of the present invention.
Figure 5B:
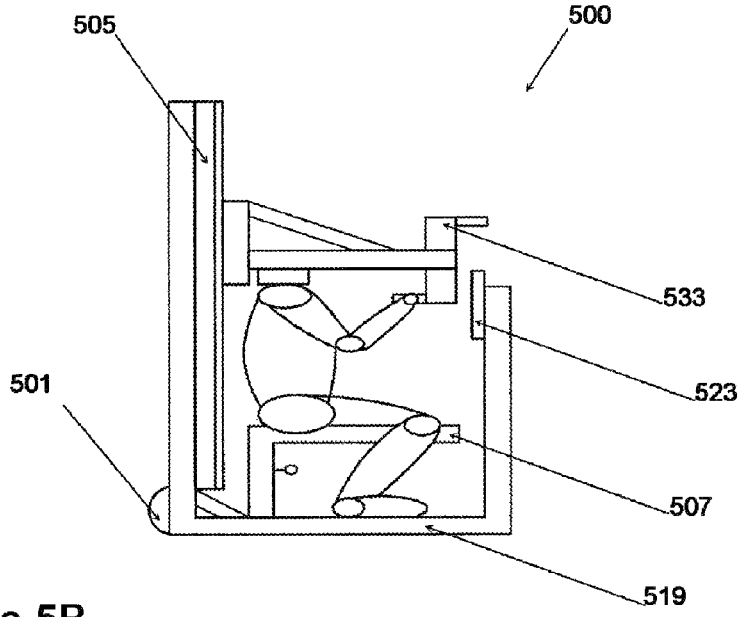

FIGS. 5A and 5B are diagrammatic side views of a user performing a pull-down on an exemplary exercise or rehabilitation machine 500 with a vertical carriage configuration, in accordance with an embodiment of the present invention. FIG. 5A shows the user at the start of a concentric contraction or at the end of an eccentric contraction, and FIG. 5B shows the user at the end of the concentric contraction or at the start of the eccentric contraction. To perform the pull-down, the user sits on an adjustable seat 507, places his feet on a footplate 519, fastens a seatbelt attached to seat 407, and grabs tubes 533. The user places a thumb over sensors at tubes 533 to move a vertical carriage 505 in the desired direction, up or down. While vertical carriage 505 is moving, the user pulls down on tubes 533 to perform the pull-down. Referring to FIG. 5A, the user places a thumb over the down sensor which activates a variable speed drive which activates an electric motor 501 which then causes a ball screw assembly to rotate causing support bearings to travel along the ball screw in a linear fashion. Since vertical carriage 505 is fixed to linear rails 511, vertical carriage 505 travels in a downward direction along linear rails 511 towards the user until the user lifts his thumb off of the down sensor or vertical carriage 505 reaches the bottom limit switch. This action enables the user to perform a concentric pull-down exercise. Referring to FIG. 5B, once the user reaches the end of the concentric pull-down, the user places a thumb over the up sensor to reverse the movement of vertical carriage 505 so that vertical carriage 505 travels in an upward direction away from the user until the user lifts the thumb off of the up sensor or vertical carriage 505 reaches the top limit switch. This action enables the user to perform an eccentric pull-down exercise. The user may then release the up sensor and cover the down sensor to repeat the concentric contraction. The user can monitor his force production throughout the various stages of the exercise by looking at a force display 523.

By pressing up on tubes 533 rather than pulling down on tubes 533 the user can perform a press while in this position on exercise machine 500. Referring to FIG. 5B, the user performs the concentric contraction by placing a thumb over the up sensor to move vertical carriage 505 upward, and, referring to FIG. 5A, the user performs the eccentric contraction by placing a thumb over the down sensor to move vertical carriage 505 downward.

Figure 6A:
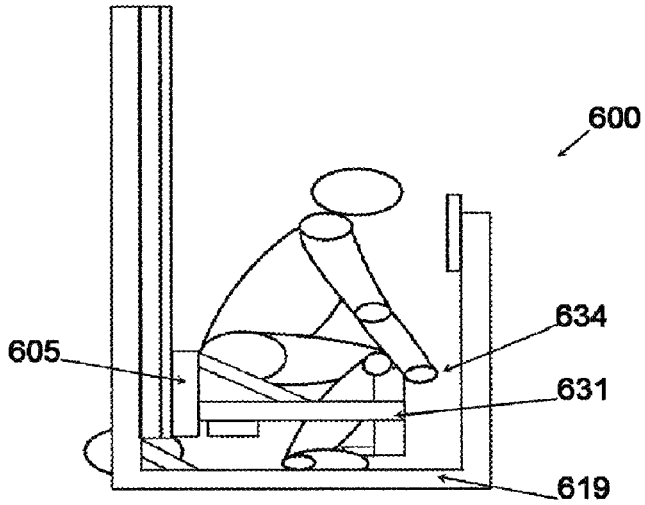
FIGS. 6A and 6B are diagrammatic side views of a user performing a dead lift on an exemplary exercise or rehabilitation machine with a vertical carriage configuration, in accordance with an embodiment of the present invention.
Figure 6B:
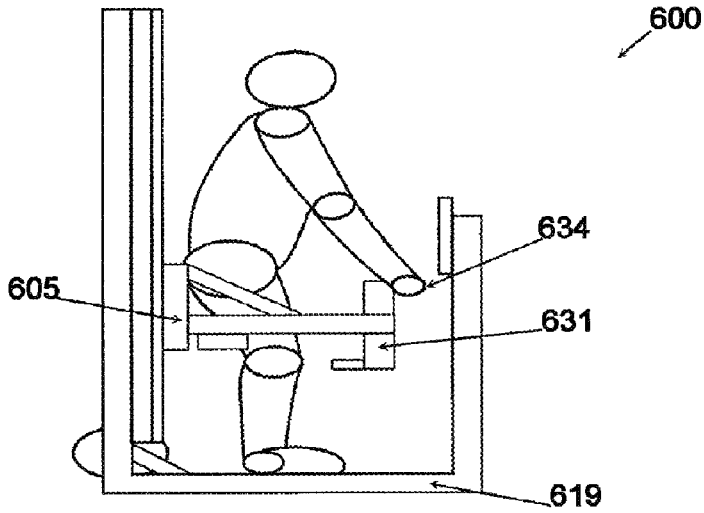

FIGS. 6A and 6B are diagrammatic side views of a user performing a dead lift on an exemplary exercise or rehabilitation machine 600 with a vertical carriage configuration, in accordance with an embodiment of the present invention. FIG. 6A shows the user at the start of a concentric contraction or at the end of an eccentric contraction, and FIG. 6B shows the user at the end of the concentric contraction or at the start of the eccentric contraction. In the present embodiment, exercise machine 600 comprises a second set of tubes 634 on the top side of horizontal handles 631. To perform a dead lift, the user stands on a footplate 619 and grabs tubes 634. The user then presses his feet into footplate 619 while controlling the movement of a vertical carriage 605 with up and down sensors at tubes 634. The concentric contraction is performed while vertical carriage 605 is moving upward, and the eccentric contraction is performed while vertical carriage 605 is moving downward.

Those skilled in the art, in light of the present teachings, will readily recognize that a multiplicity of alternate exercises may be performed on exercise and rehabilitation machines with vertical carriage configurations in accordance with preferred embodiments of the present invention such as, but not limited to, dips, squats, calf raises, abdominal crunches, rows, shrugs, etc.

Figure 7:
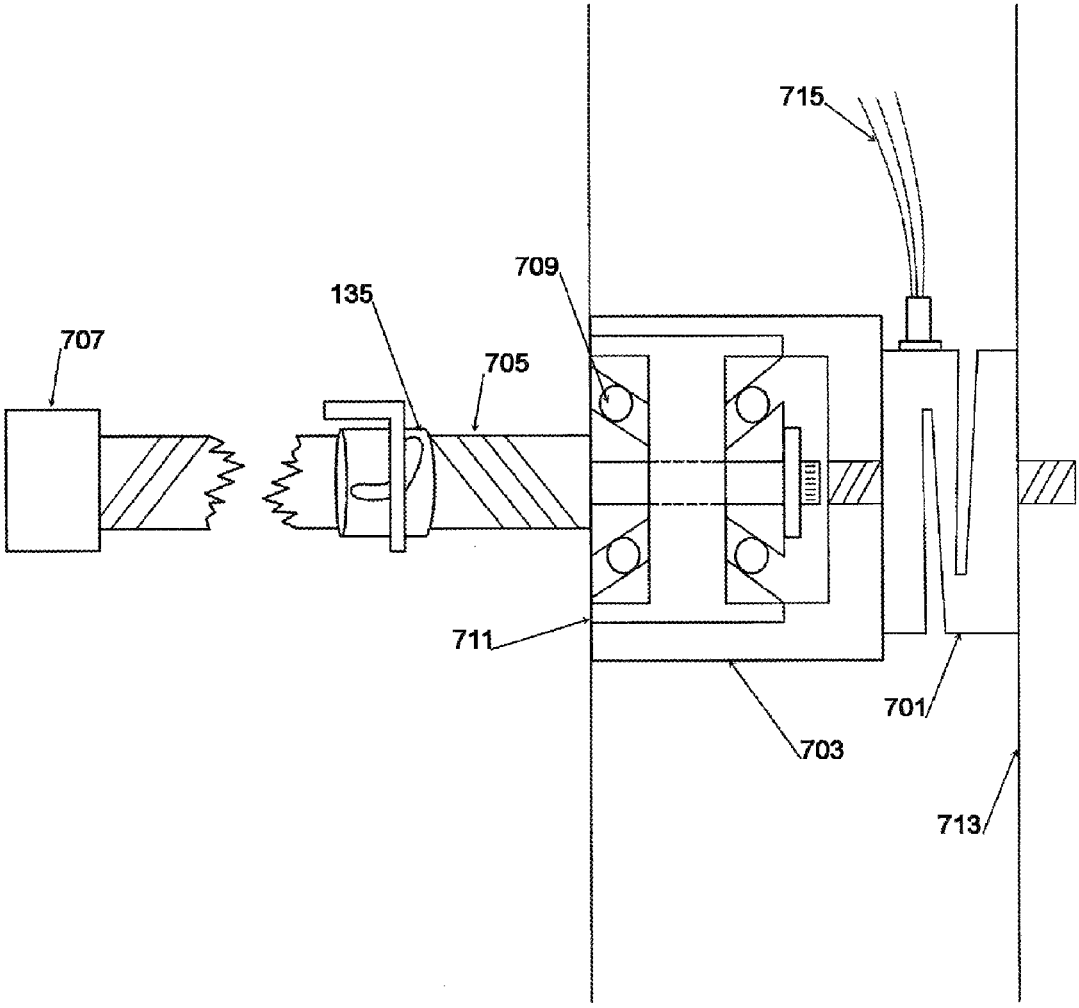
FIG. 7 is a diagrammatic top view of an exemplary load cell assembly from an exercise and rehabilitation machine, in accordance with an embodiment of the present invention.

FIG. 7 is a diagrammatic side view of an exemplary load cell assembly from an exercise and rehabilitation machine, in accordance with an embodiment of the present invention. In the present embodiment, the load cell assembly comprises a load cell 701, a load cell adaptor 703, a ball screw 705, and a motor 707 with a gear reduction box. Ball screw 705 is attached to two tapered bearings 709 enclosed in a bearing housing 711 which is fixed to load cell adaptor 703. Load cell 701 is fixed to a frame 713 of the exercise machine. In the present embodiment, ball screw 705 is joined to two tapered bearings 709 enclosed in a bearing housing 71 land ball nut 135 travel along the screw. Load cell 701 is preferably attached to frame 713 at the forward most cross brace between the horizontal beams in an exercise machine with a horizontal configuration, shown by way of example in FIG. 1, or to the top most cross brace between the vertical beams in an exercise machine with a vertical configuration, shown by way of example in FIG. 4. Those skilled in the art, in light of the present teachings, will readily recognize that the load cell may be located in various different locations in alternate embodiments. For example, without limitation, in an alternate embodiment with a horizontal configuration the load cell may be located behind the footplate. In an alternate embodiment with a vertical configuration, the load cell may be located under the footplate or under the seat. In these embodiments the load cell must take into account the weight of the user to accurately calculate the force. In the present embodiment when a user exerts force on the exercise machine, this force is translated through frame 713 to load cell 701. Load cell 701 then sends this information through wires 715 to a force display, for example, without limitation, touch screens 123 and 423 shown by way of example in FIGS. 1 and 4, respectively.

Turning now to FIGS. 8-20, it is seen that an additional preferred embodiment of a machine 1000 is illustrated. It is to be understood that any exact measurement/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

The machine has a frame 1100, a handle assembly 1220, a signal box 1260 and a drive assembly 1270 including a spool assembly 1320.

The machine frame 1100 with a vertical section 1110 and a horizontal section 1140. The vertical section 1110 is a top 1111 and a bottom 1112, and preferably has two spaced apart parallel members 1113 and 1114, respectively. Two guide posts 1115 and 1116, respectively, can be formed between the members 1113 and 1114. The guide posts 1115 and 1116 are preferably fixed in predetermined locations along the vertical section 1110 of the frame 1100.

The horizontal section 1140 has a first end 1141 and a second end 1142, and preferably has two spaced apart parallel members 1143 and 1144, respectively. Three guide posts 1145, 1146 and 1147, respectively are provided and are preferably fixed in predetermined locations along the length of the horizontal sections 1140 of the frame 1100. A bracket 1148 is further provided. Two side gussets 1150 are preferably provided for lateral stability. A longitudinal gusset 1155 is provided for longitudinal stability, and is interconnected between the horizontal section 1140 and the vertical section 1110. A bracket 1156 is provided on the longitudinal gusset 1155 for a lock (described below).

A seat section 1160 is removably connected to and supported by the horizontal section 1140 of the frame 1100. The seat section 1160 has a load supporting arm 1165 pivotally and removably connected to the horizontal section 1140. A vertical locking arm 1170 is further provided. The vertical locking arm 1170 is rigidly connected to the load support arm 1165 at a right angle. The vertical locking arm 1170 has a lock 1171 at its distal end that is removably connected to bracket 1156. The load support arm is preferably perpendicular to the horizontal section 1140 when the lock 1171 is connected to the bracket 1156. An angled locking arm 1175 is further provided. The angled locking arm 1175 is pivotally connected to the rear of load support arm 1165. The angled locking arm 1175 has a lock 1176 at its distal end that is removably connectable to bracket 1148. The load support arm 1165 is angled away from the vertical section 1110 when the angled locking arm 1175 is locked to bracket 1148. A docking station 1350 is further provided. The docking station 1350 provides a stationary location on the load support arm 1165 to connect handles (described below) when the handles do not extend and retract during certain exercises such as squats.

The seat section 1160 further has a horizontal attachment arm 1180 that is removably connected to the top of the load support arm 1165. The horizontal attachment arm 1180 has rings 1181 and 1182 at opposed ends of the arm. Cushions 1185 can be provided on the vertical locking arm 1170 (seat cushion) and the top of the load support arm 1165 (back cushion). A belt strap 1190 is further provided.

A foot plate 1200 is further provided. It is preferably located at end 1142 of the horizontal section 1140 of the frame 1100. Foot plate 1200 preferably extends a selected distance on each side of the horizontal section 1140.

Figure 12:
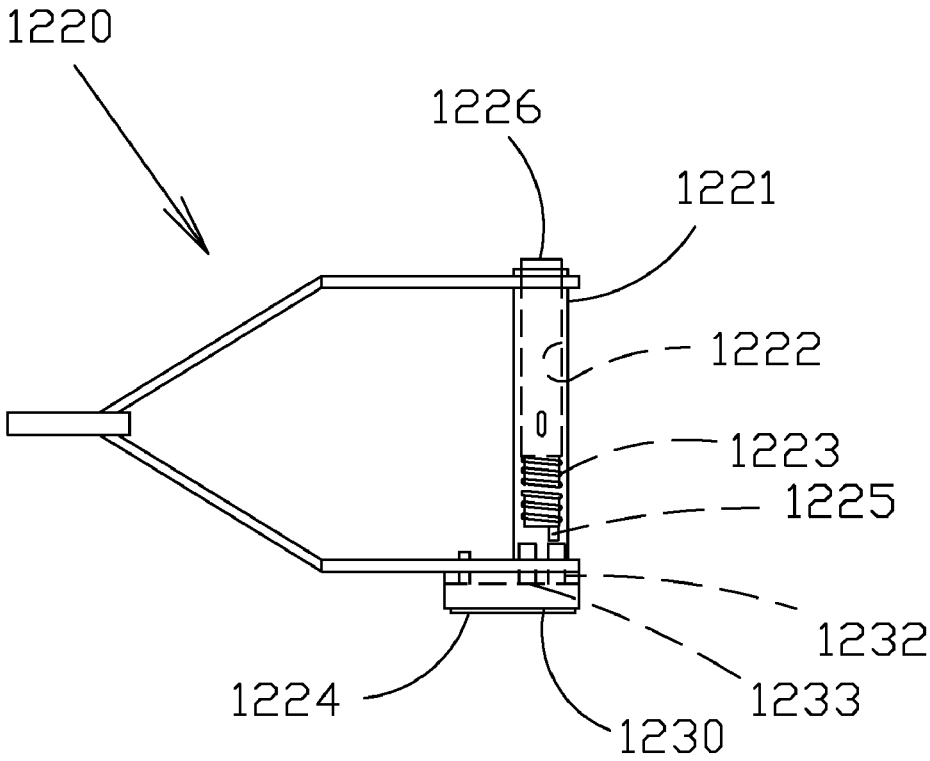
FIG. 12 is a side plan view illustration of the handle with attached wireless sensor in accordance with an embodiment of the present invention.
Figure 12A:
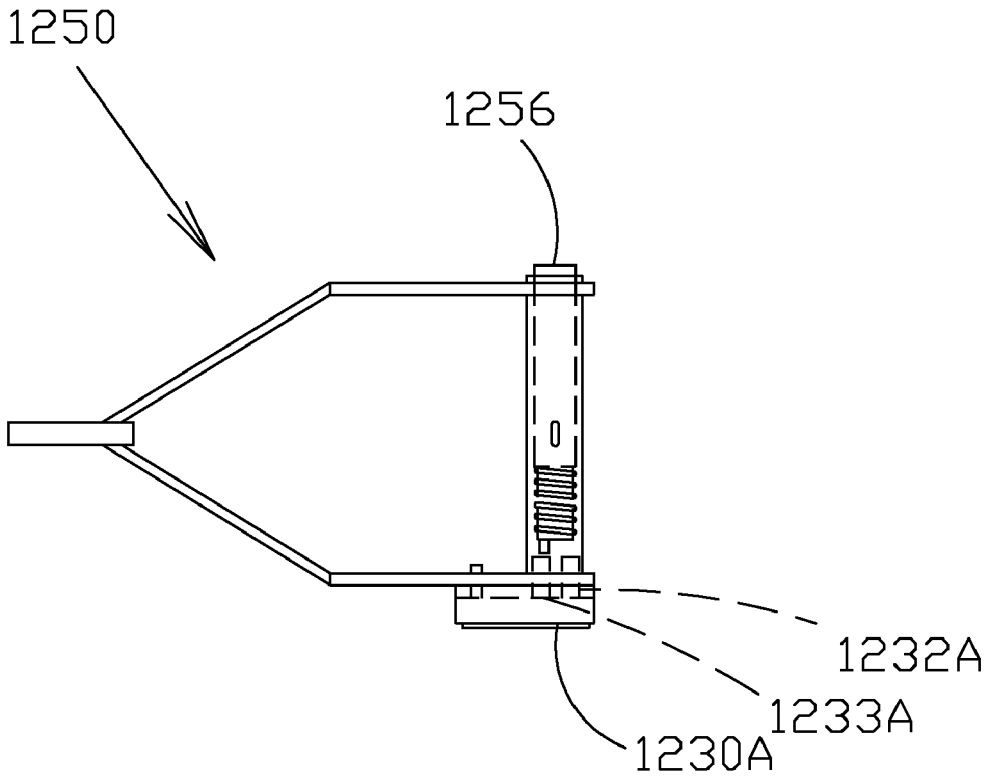
FIG. 12A is a side plan view illustration of the handle with attached wireless sensor in accordance with an embodiment of the present invention.
Figure 13:
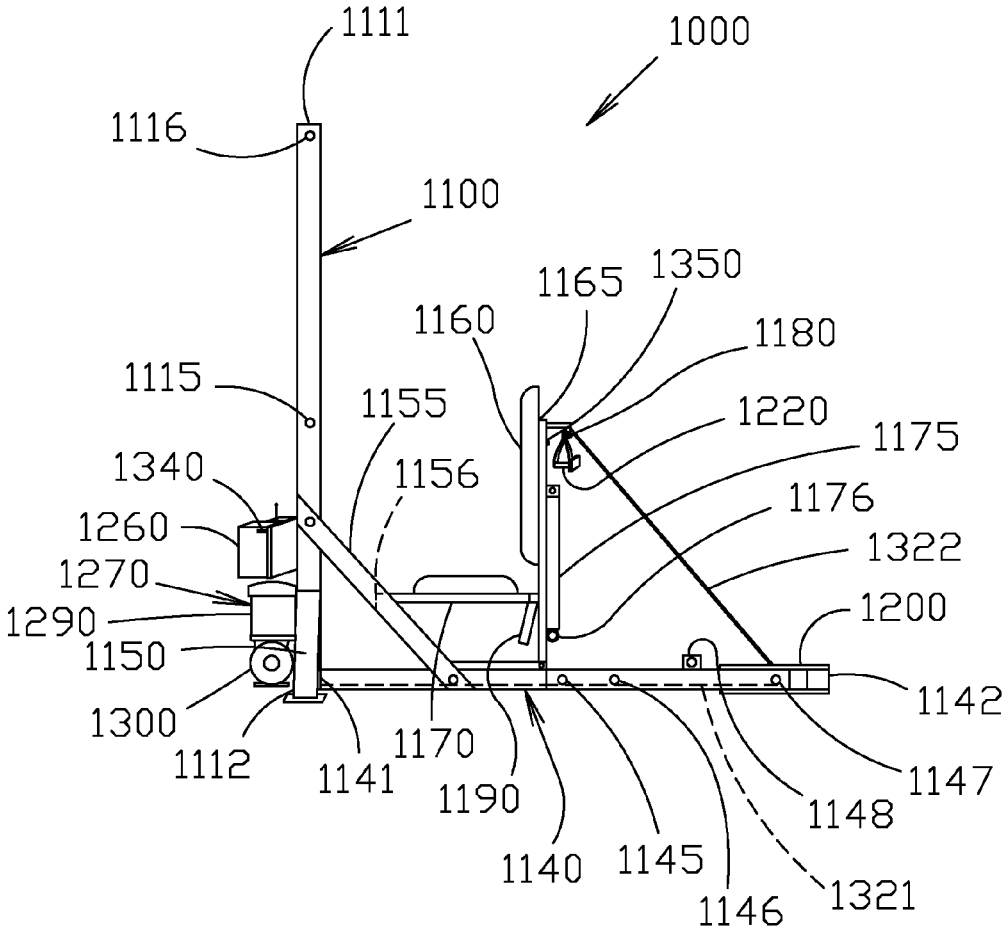
FIG. 13 is a side plan view of a preferred embodiment illustrating the vertical and horizontal portions of the frame with attached spool assembly, motor, gear box and force transducer, signal transmission box, variable speed drive, a seat assembly, a foot plate, the wireless control handle and the spool line in accordance with an embodiment of the present invention.

A handle assembly 1220 is further provided, and is best seen in FIG. 12. The handle assembly 1220 has a bar 1121 with an insert 1222, a coil spring 1223, a receiver 1224, a button extension 1225 and a button 1226. In the present embodiment, both ends of the rod inserts 1222 extend beyond the ends of the hollow handle bar 1221. A hollow receiver portion 1224 is attached to the bottom of the handle bar 1221.

Figure 10:
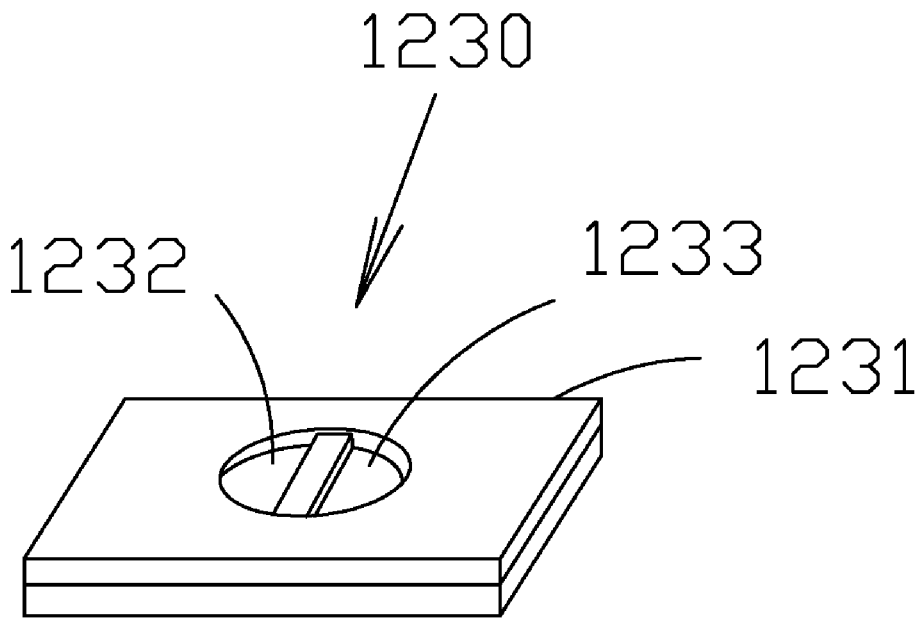
FIG. 10 is an side view of the wireless sensor device in accordance with an embodiment of the present invention.
Figure 11:
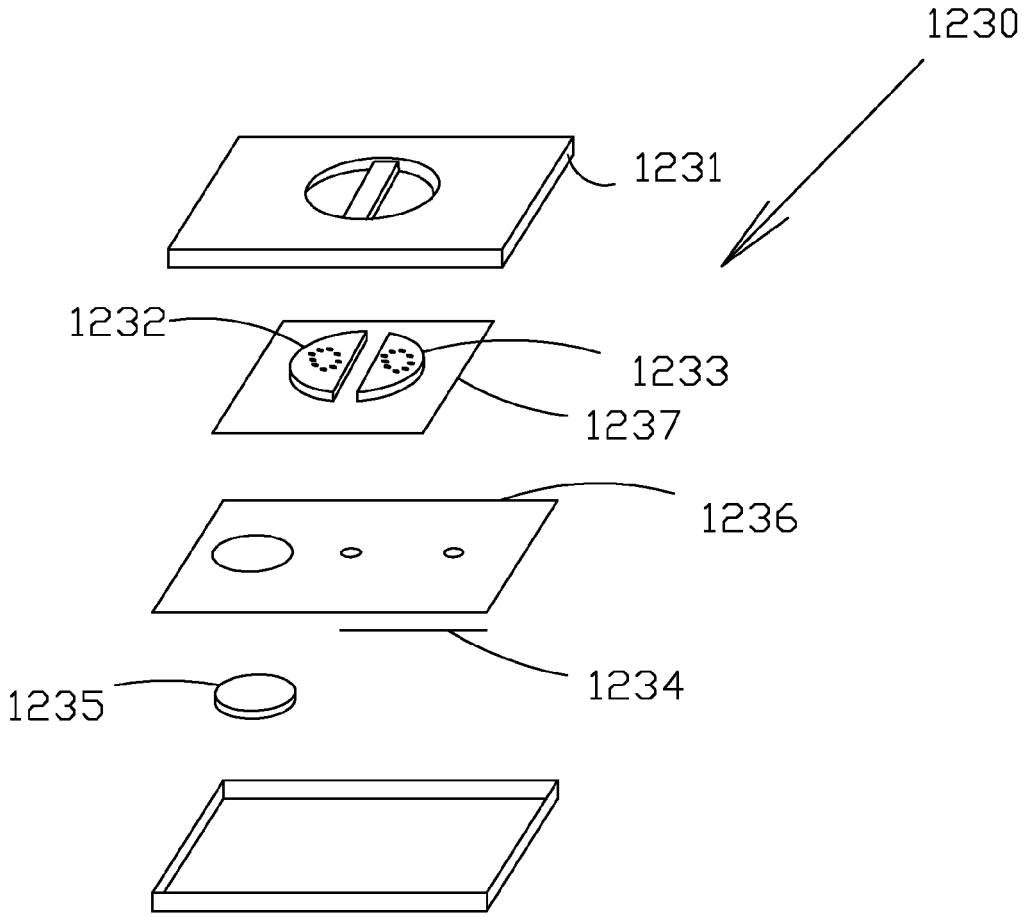
FIG. 11 is an exploded side view of the wireless sensor components in accordance with and embodiment of the present invention.

A control 1230 is provided on the handle assembly 1220 on the opposite end of the button 1226. The control 1230 is best illustrated in FIGS. 10-12. The control 1230 has a housing 1231 that preferably has two removably connectable pieces. The control 1230 also has two push buttons 1232 and 1233 (forward and reverse), an antenna 1234, a battery 1235, a circuit board 1236 and a cover 1237 for the circuit board 1236. Button 1226 can be actuated to facilitate depression of push button 1232.

Control buttons 1232 and 1233 are fitted into the hollow receiver portion 1224. The end of the rod insert 1222 that is in contact with the embedded wireless sensor 1230 includes a small button extension 1225 which would contact solely one of the two button controls 1232 or 1233 of the wireless sensor 1230. The other exposed end of the rod insert 1222 acts as a button lever, responding to the user's hand motion and thus pushing down onto one of either release or retraction control buttons 1232 and 1233 of the wireless sensor 1230 depending which way the sensor is oriented in the hollow receiver portion 1224. The contact between the rod insert 1222 and the control button 1232 and 1233 of the wireless receiver 1230 sends a signal to the signal receiver 1262 activating the movement of the spool assembly 1320. The handle assembly 1220 can be detached and re-attached to the spool line 1321 by way of an adjustable connector piece such as but not limited to a hook, a screw or a clip.

A second handle 1250 can be further provided, and is similar to handle 1220. IT has a push button 1256 that can depress one of push buttons 1232A and 1233A of a control 1230A. In the preferred embodiment, the button 1256 actuates button 1233A (reverse). Yet, it is understood that a single communicating handle with both forward and reverse could be used in combination with a second non-communicating handle without departing from the broad aspects of the present invention.

Figure 8:
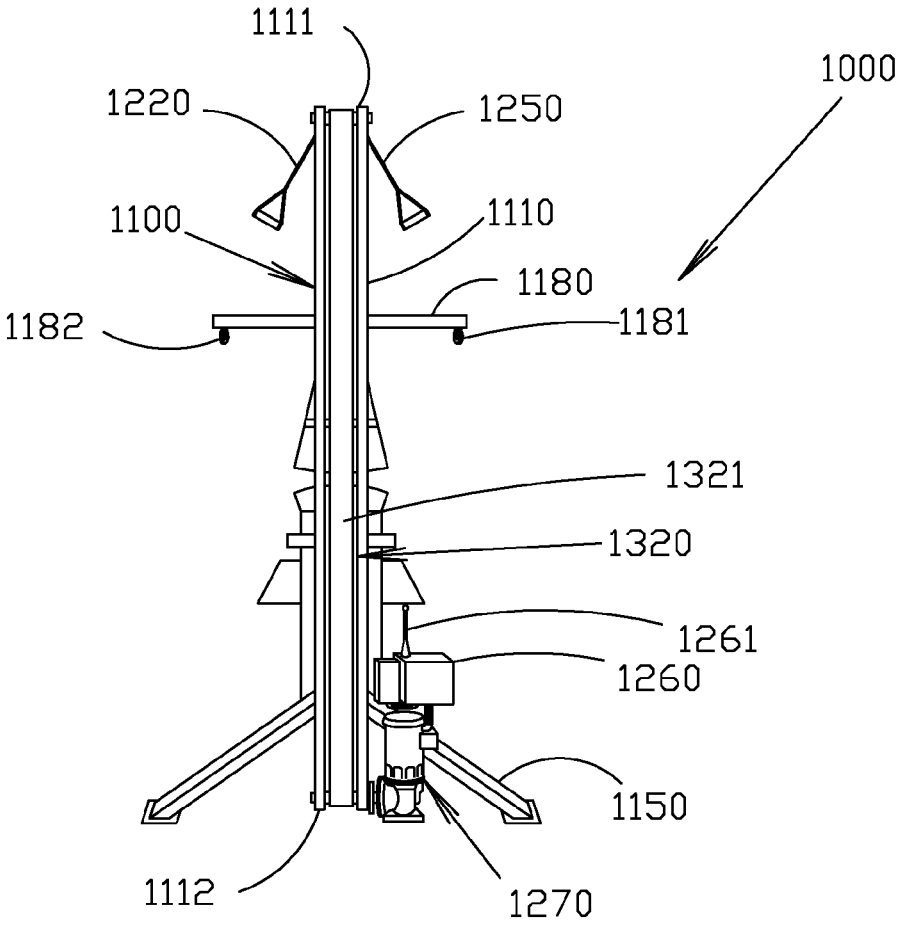
FIG. 8 is a front view of the device illustrating the vertical portion of the frame with attached spool assembly, motor, gear reduction box an force transducer, signal transmission box, and variable speed drive in accordance with an embodiment of the present invention.
Figure 9:
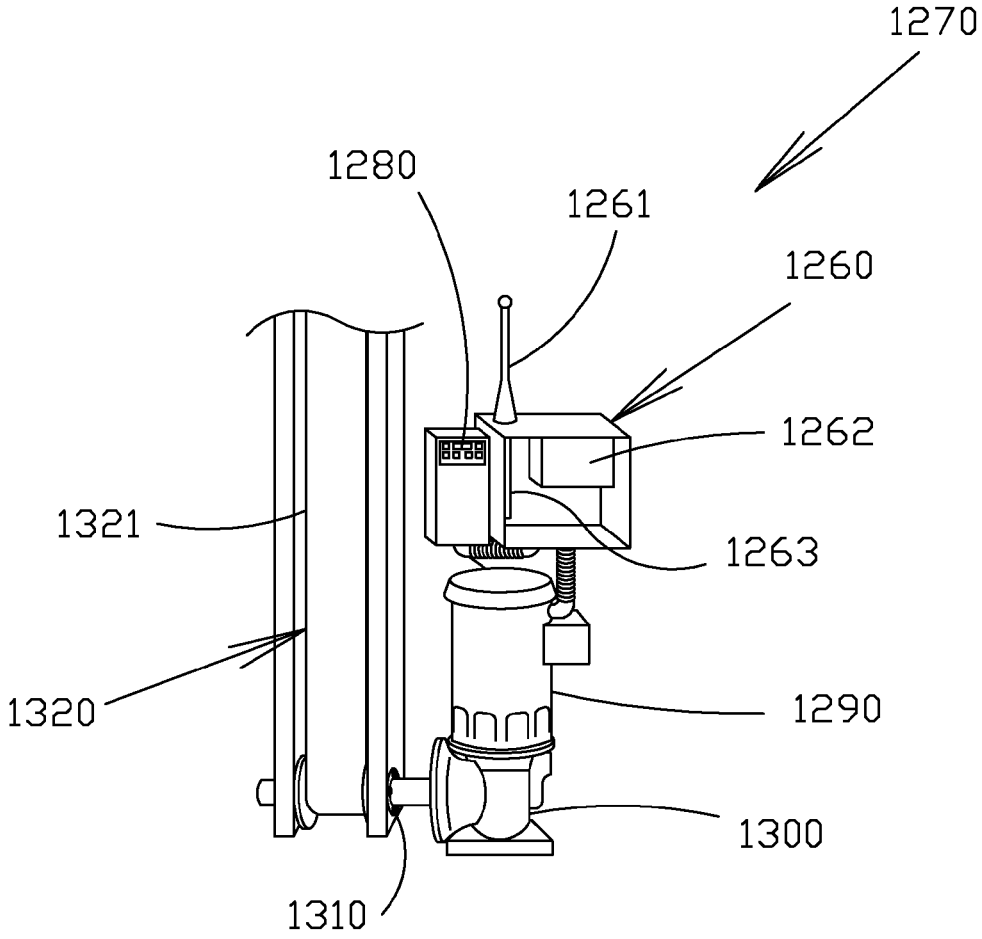
FIG. 9 is an isolation front view of the spool assembly, spool line, motor, gear reduction box, force transducer, signal transmission box, and variable speed drive in accordance with an embodiment of the present invention.

Looking now to FIGS. 8 and 9, it is seen that a signal box 1260 with an antenna 1261, a signal receiver 1262 and a signal converter 1263 is further provided. A communication port 1340 (examples are wireless or USB connection) is preferably provided for communicating with an external device such as a computer.

Keeping with FIGS. 8 and 9, it is seen that a drive assembly 1270 is provided. The drive assembly 1270 has a variable speed drive 1280, a motor 1290, a gear box 1300, a force transducer 1310 and a spool assembly 1320. The spool assembly 1320 has a line 1321 that can be a single continuous line or a sectional line. Line 1321 has a first end that is fixed to a spool member, and a second end that can be selectively unwound and wound about the spool. The spool assembly 1320 further has one or more extension wires 1322 that can be removably secured to the end of the line 1321. The spool line 1321 can be selectably placed within the vertical 1110 or horizontal section 1140 of the frame 1100, and leveraged about a selected guide post. The spool line within a spool assembly selectably unwinds and winds as it moves along a linear path parallel to the first or second portions and may be leveraged at any location along or near the frame 1100.

A waste carriage 1330 can be included for use with certain exercises.

Several of the figures will now be described in detail, as are details of the components outlined above.

FIGS. 8 and 9 illustrate a preferred embodiment of the exercising machine 1000 showing the vertical portion of the frame 1110 with attached spool assembly 1320, electric motor 1290, gear reduction box 1300, force transducer 1310, signal transmission box 1260, and variable speed drive 1280 in accordance with an embodiment of the present invention. The spool assembly containing spool line 1321 is located near the gear reduction box 1300 and electric motor 1290. The gear reduction box 1300 reduces the speed of rotation of the spool line 1321 otherwise created by the motor 1290 alone for any given amount of torque produced. In the current preferred embodiment, the gear reduction box 1300 reduces the speed of rotation caused by the motor 1290 at a 96:1 ratio. The motor 1290 is preferably capable of running at a maximum of one horse power. A force transducer 1310 located near the spool assembly 1320 and the motor 1290 for purposes of measuring real time tension between the machine 1100 and the user during exercise. The force transducer 1310 is further connected by wire to a signal receiver 1262 within the signal transmission box 1260 where the received signals are converted to standard data. The converted data may be transferred to an external data storage device or external digital display provided by the user by way of a communication port such as a USB port. The signal transmission box 1260 further contains an antenna 1261 and wireless signal receiver for receiving signals from the wireless controls. The spool assembly 1320 has a central stretch resistant strap 1321 wounded to the spool assembly 1320 and connected at the other end to either one or two metal round wires 1322 (depending on the type of exercise implemented). Signals from the handle assembly 1220 are transmitted through the signal receiver 1262 to the motor 1290, activating the rotation of the motor 1290, a gear in gear box 1300 and the spool assembly 1320. The speed of rotation is preset in the variable speed drive 1280 which can be manually changed in the current preferred embodiment of wirelessly changed in an alternate embodiment. For any given amount of power generated by the motor, the gear reduction box 1300 will reduce the speed of rotation of the spool assembly 1320 for that same unit of power by a 96:1 rate.

The force transducer 1310 is connected to the spool assembly 1320 to measure opposing tensions on the spool line 1321 generated by the user and the machine. The preferred embodiment utilizes a flange style reaction torque transducer. Alternate embodiments of this device may use equivalent type of transducer equipment to achieve the same results. The tension registered by the force transducer 1310 is transmitted to the signal converter 1263 and converted to standard data. The standard data is ultimately converted into readable data either by preprogrammed hardware or downloadable software.

The control 1230 housing 1231 protects the components of the control. Push button controls 1232 and 1233, and an optional antenna wire 1234 can protrude from the external housing. When pressed, the buttons 1232 and 1233 send a wireless signal to the signal receiver 1262 attached to the signal transmission box 1260, activating the rotation of the spool assembly 1320 in either forward or reverse, depending on which button is depressed. It is appreciated that the selection of forward and reverse motion of the spool assembly 1320 is activated by the buttons which can be located on the handles that can be moved about the machine 1000. It is further understood that is alternative embodiments, the wireless control may take advantage of existing technology and need not be embodied in a hand held wireless device, such as but not limited to the case of voice recognition technology, heat sensory technology, or digital automation.

In typical use of the present embodiment, the user stands on foot plate 1200 or sits on the seat assembly 1160, grabs the handles 1220 and 1250 and places a thumb over the spring loaded button 1226 of the handle assembly 1220. Pressing the button 1226 with a thumb activates the wireless sensor 1230, sending a signal to the receiver 1262 which activates the drive assembly 1270.

Figure 14A:
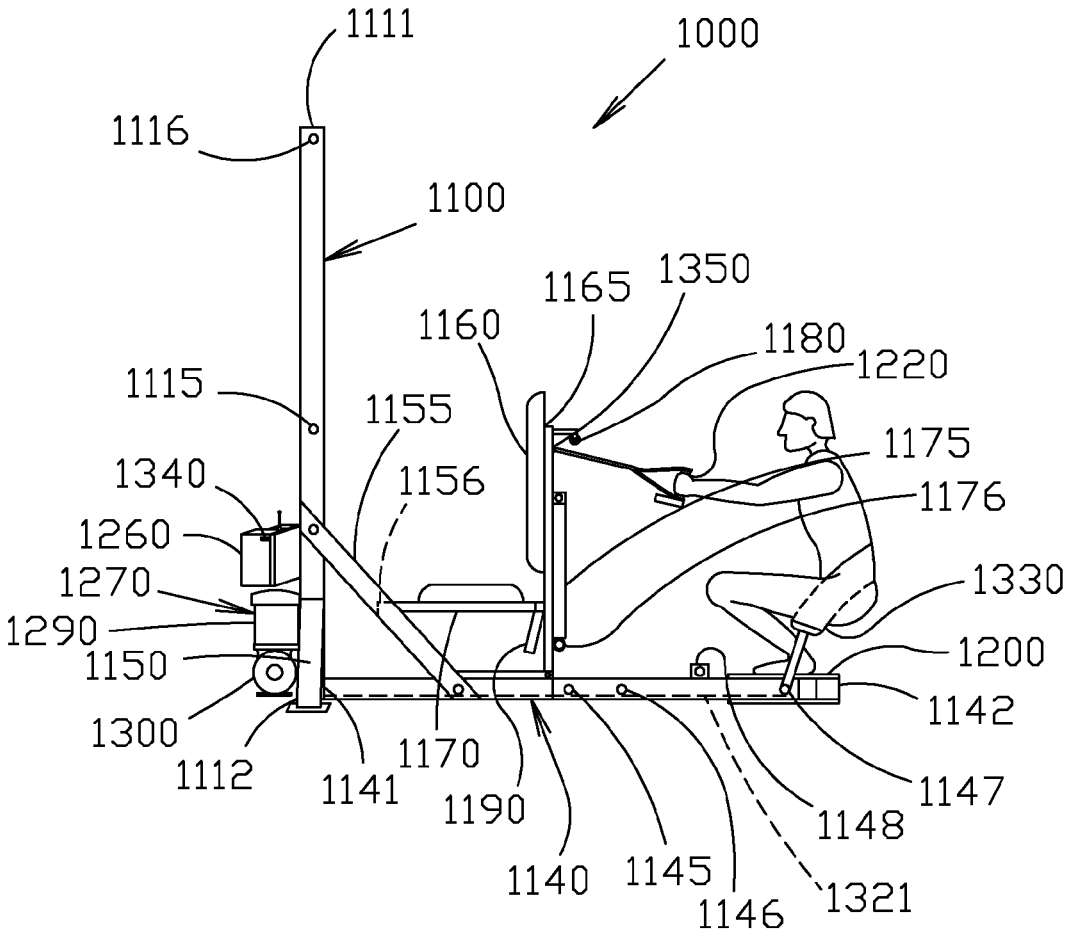
FIGS. 14A and 14B are side plan views of a preferred embodiment illustrating the vertical and horizontal portions of the frame with attached spool assembly, motor, gear box, force transducer, signal transmission box, variable speed drive, a seat attachment, a foot plate, the wireless control handle and the spool line in accordance with a user performing a squat exercise in accordance with an embodiment of the present invention.
Figure 14B:
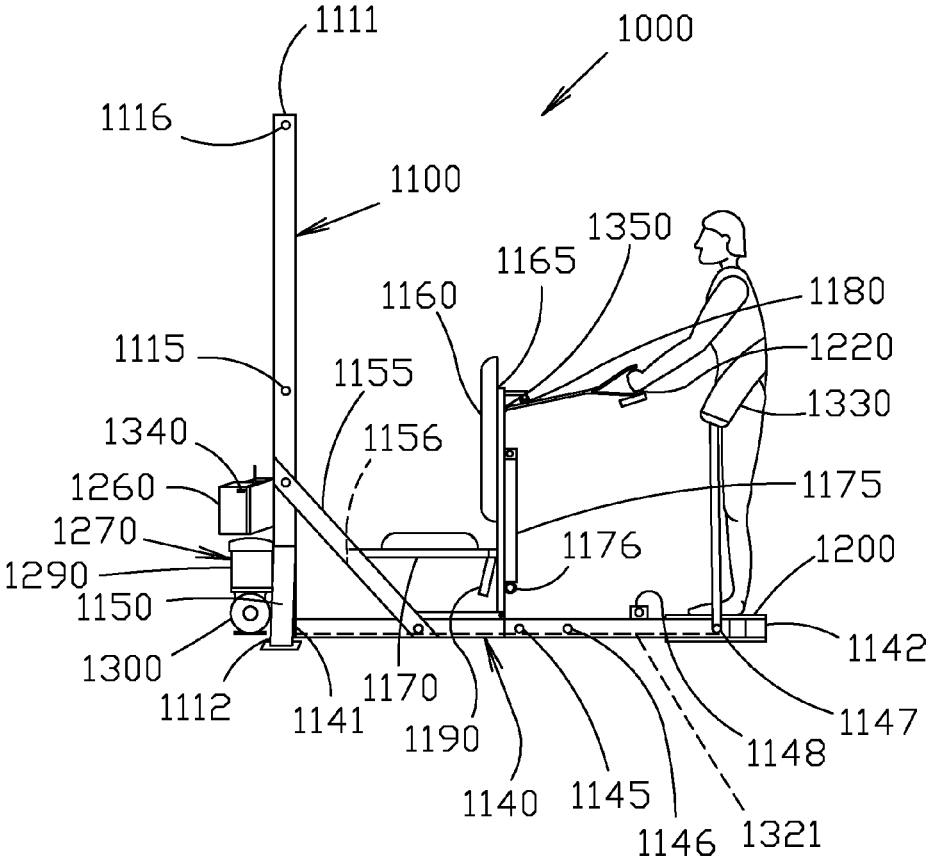

FIGS. 14A and 14B are side views of a user performing a squat exercise in an alternate embodiment of the device 1000 with the spool line 1321 threaded through a guide post 1147 on the horizontal portion 1140 of the frame 1100. A waist carriage 1330 (a belt attachment) is connected to the end of the spool line 1321 which is wrapped around the mid-section of the user's body. The wireless handle control 1220 is separately attached to a docking station 1350 on the load support arm 1165 of the seat assembly facing the user and may be used to help stabilize the user's body in the standing position while controlling the release and retraction of the spool line 1321 during squat exercises. FIG. 14A shows the user at the start of a concentric contraction or the end of an eccentric contraction. FIG. 14B shows the user at the end of a concentric contraction or the start of an eccentric contraction. As the user moves from the squat position to the standing position, his body will push against the waist carriage 1330 and pull against the spool line 1321 in an up and outward motion from the horizontal portion of the frame 1100. To perform a squat the user stands on the footplate 1200 and holds onto the handles 1220 and 1250. Referring to FIG. 14B, when the user's legs are extended, the user will cause the spool line 1321 to retract while the user exerts force against the waist carriage 1330 during the eccentric movement. In the current embodiment as shown in FIGS. 14A and 14B, the user can view real time measurements of the total force exerted at any stage of contraction and exercise from the user's personal computer (not shown in this illustration) connected to the USB port 1340 from the signal transmission box 1260.

Figure 15A:
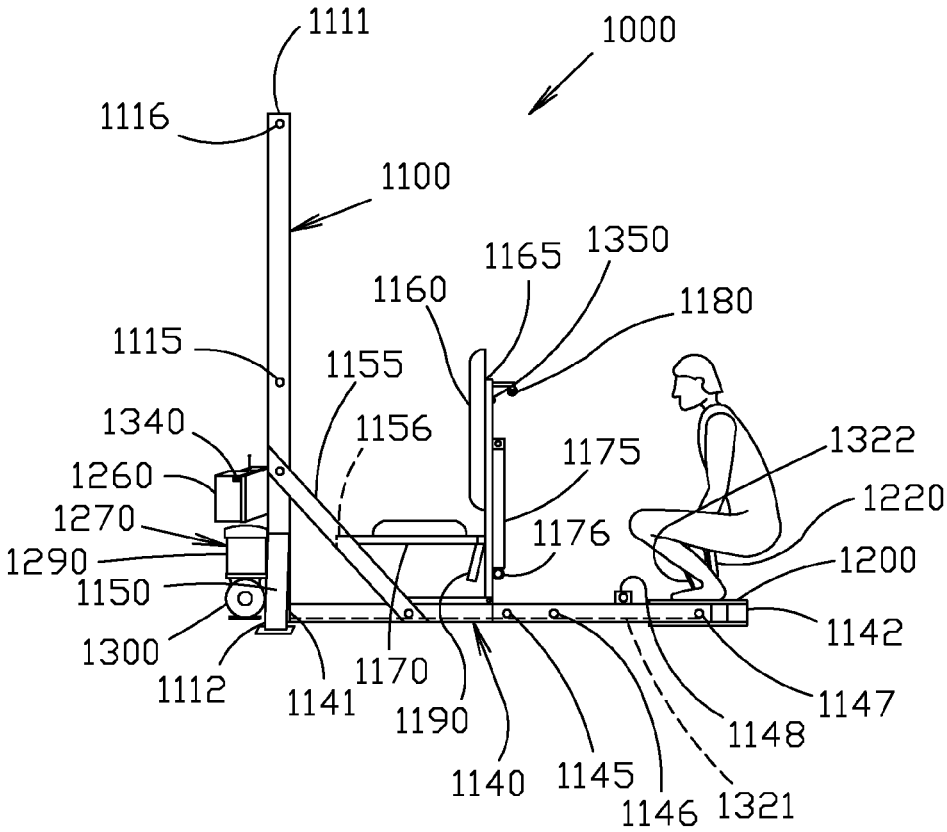
FIGS. 15A and 15B are side plan views of a preferred embodiment with a user performing a dead-lift while standing on the foot plate on the horizontal portion of the frame in accordance with an embodiment of the present invention.
Figure 15B:
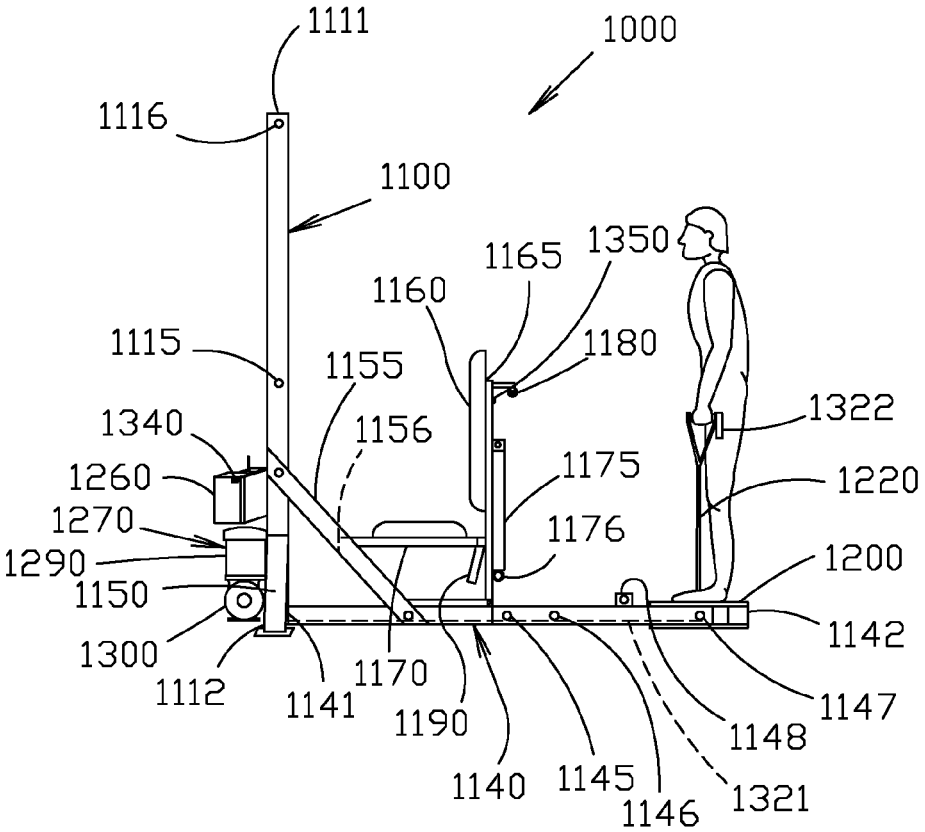

FIGS. 15A and 15B are side views of a user performing a dead-lift exercise. Spool line 1321 threaded through a guide post 1147 on the horizontal portion 1140 of the frame 1100. Handles 1220 and 1250 are attached to the ends of the spool line 1231 from which the user will be pulling against. FIG. 15A shows the user at the start of a concentric contraction or the end of an eccentric contraction. FIG. 15B shows the user at the end of a concentric contraction or the start of an eccentric contraction.

Figure 16A:
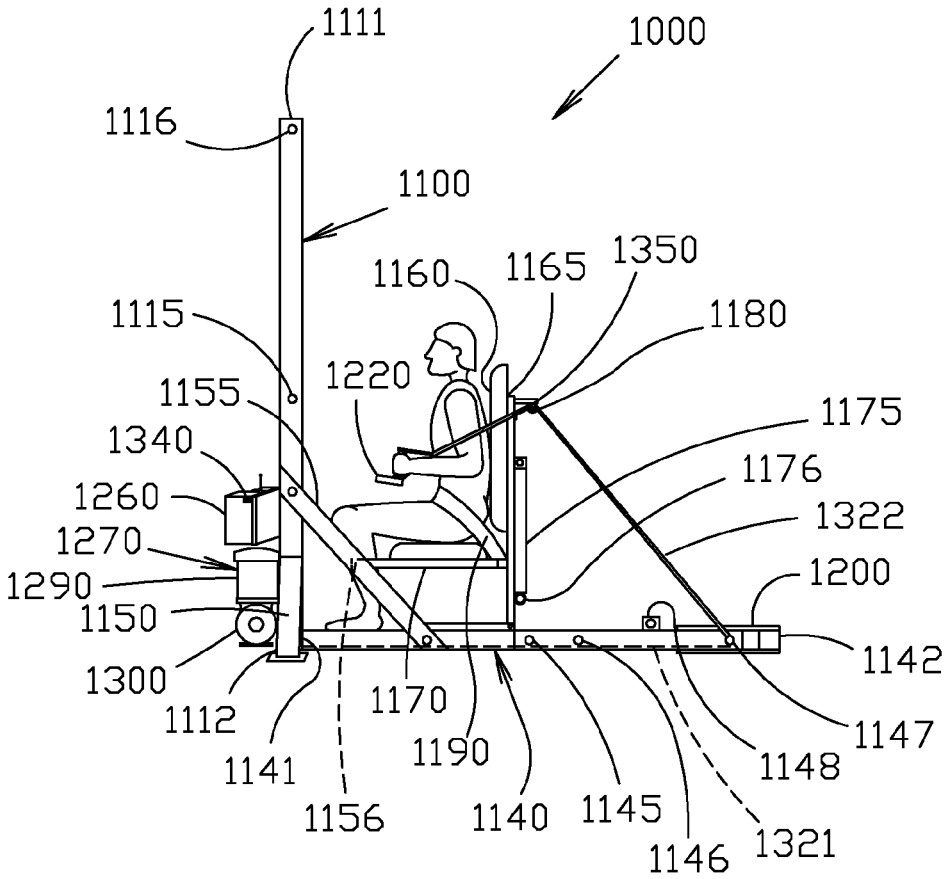
FIGS. 16A and 16B are side plan views of a preferred embodiment with a user performing a bench press while seated on the seat assembly on the horizontal portion of the frame in accordance with an embodiment of the present invention.
Figure 16B:
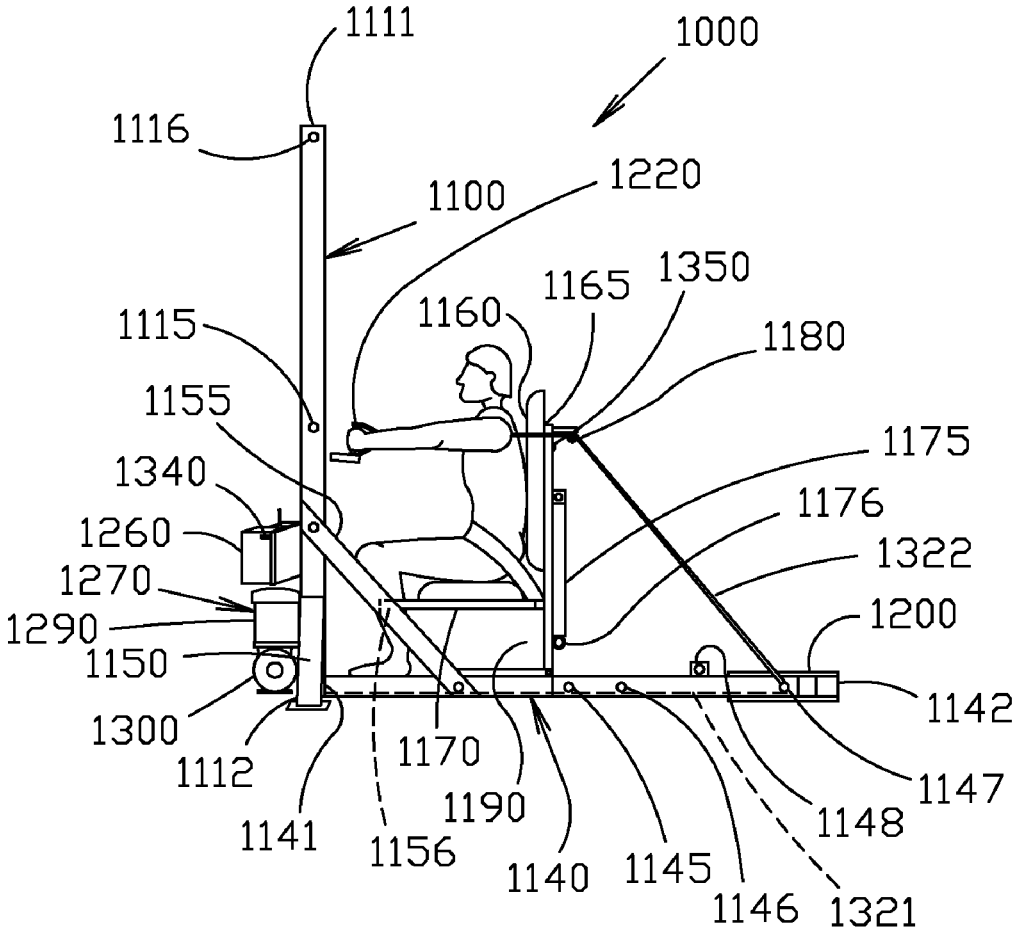

FIGS. 16A and 16B are side views of a user performing a bench press exercise. Spool line 1321 is threaded through a guidepost 1147 on the horizontal portion 1140 of the frame 1100. The wireless control handles 1220 and 1250 are connected to the ends of the spool line 1321 to be in contact with the user. FIG. 16A shows the user at the start of a concentric contraction or the end of an eccentric contraction. FIG. 16B shows the user at the end of a concentric contraction or the start of an eccentric contraction.

Figure 17A:
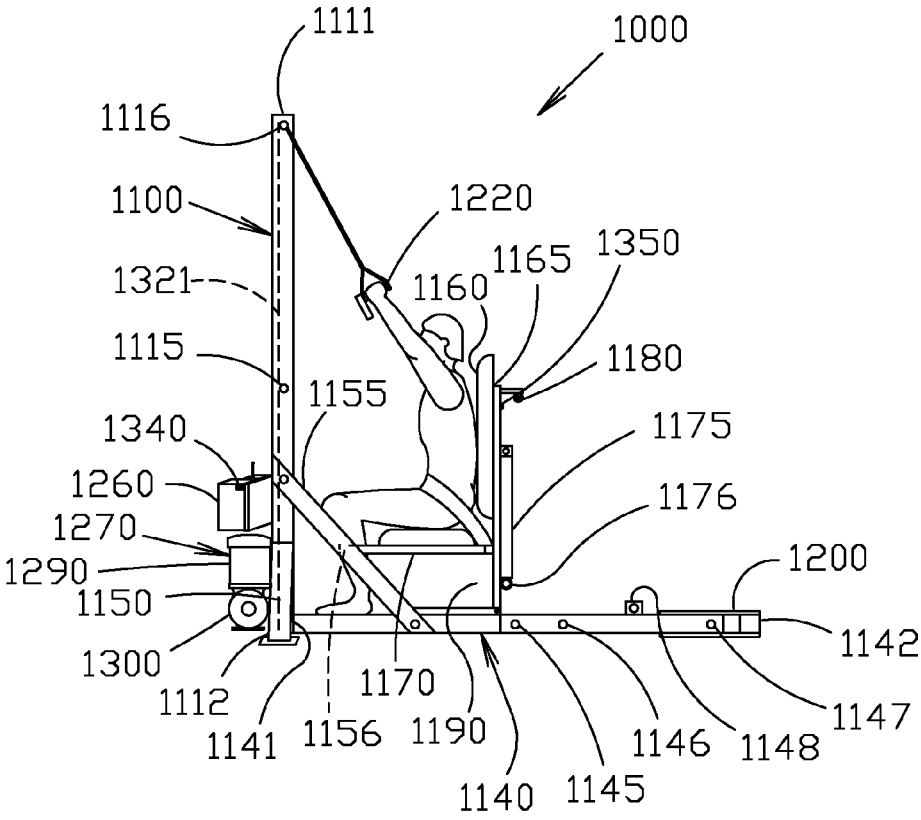
FIGS. 17A and 17B are side plan views of a preferred embodiment with a user performing a pull-down exercise while seated on the seat assembly on the horizontal portion of the frame in accordance with an embodiment of the present invention.
Figure 17B:
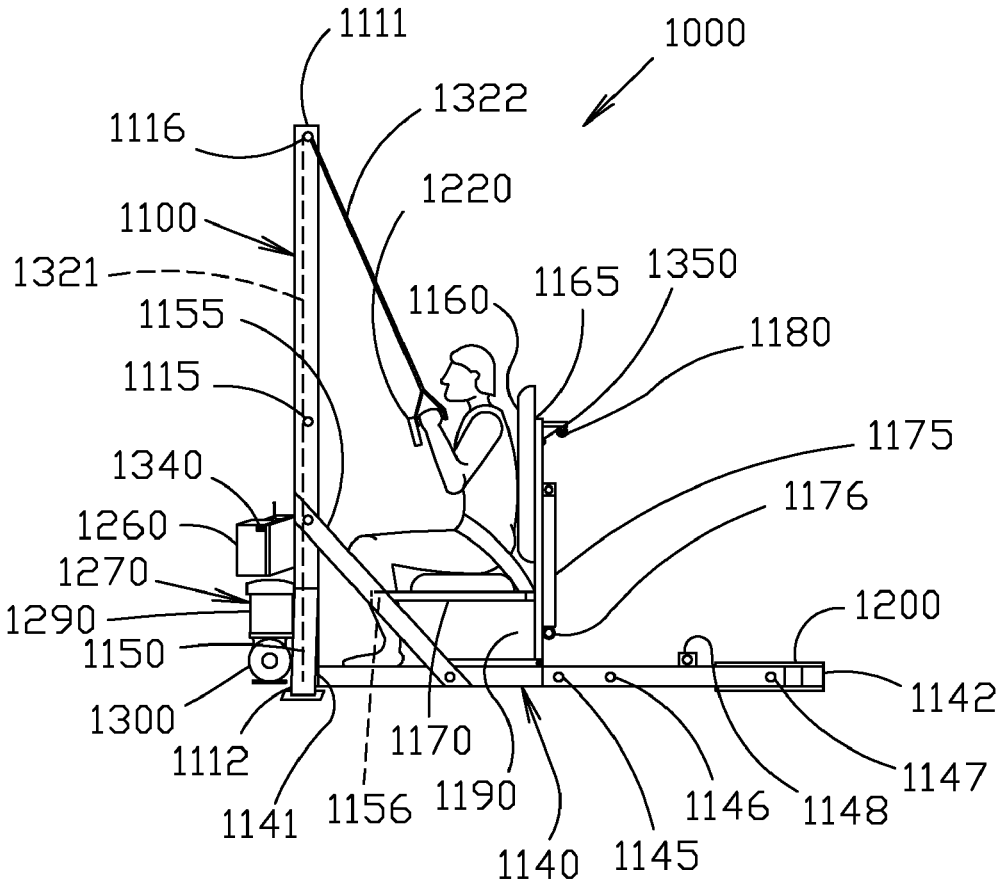

FIGS. 17A and 17B are side views of a user performing a pull-down exercise. The spool line 1321 is threaded through a guide post 1116 on the vertical portion 1110 of the frame 1100. FIG. 17A shows the user at the start of a concentric contraction or the end of an eccentric contraction. FIG. 17B shows the user at the end of a concentric contraction or to the start of an eccentric contraction.

Figure 18A:
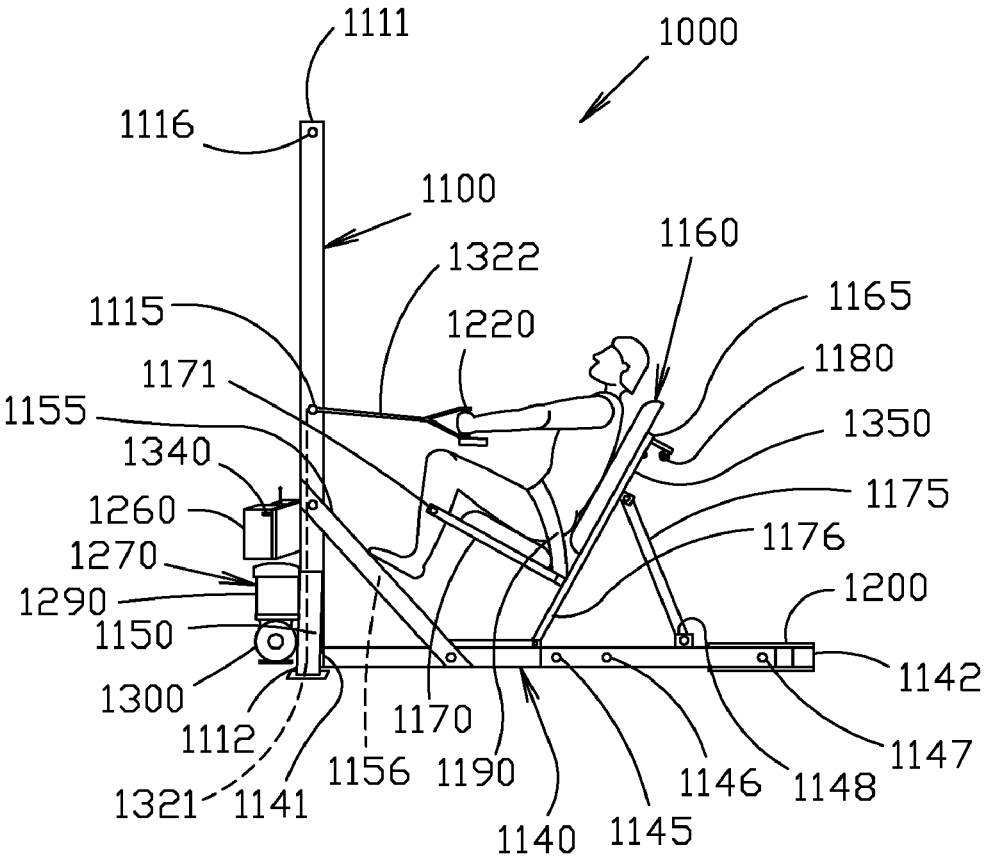
FIGS. 18A and 18B are side plan views of a preferred embodiment with a user performing a row exercise seated on the seat assembly in the slanted position on the horizontal frame portion in accordance with an embodiment of the present invention.
Figure 18B:
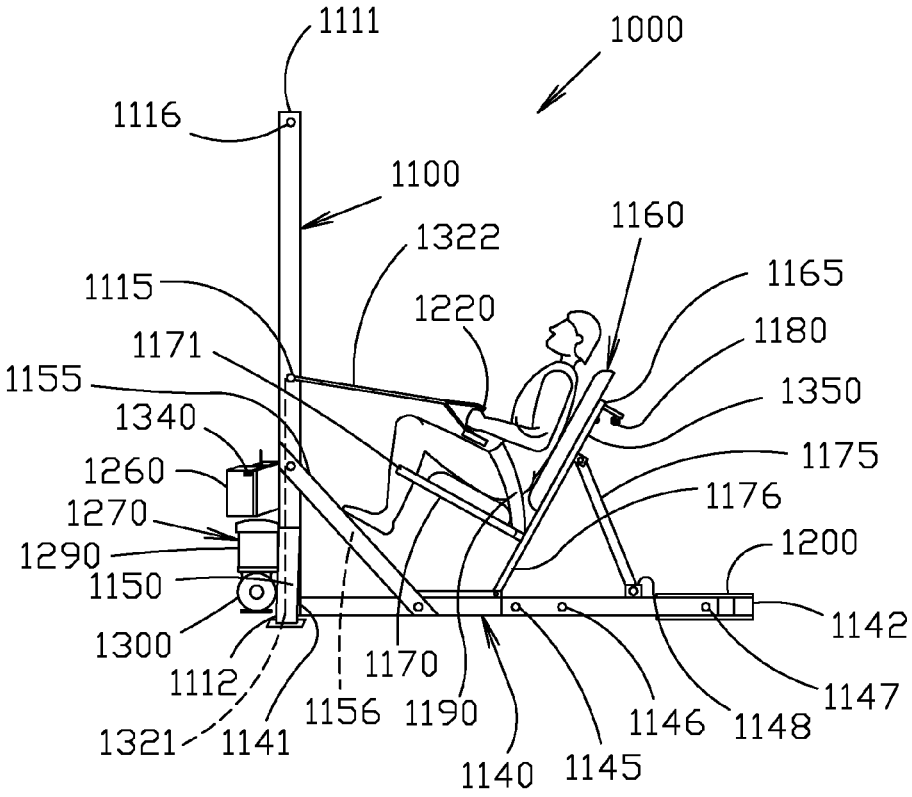
Figure 19:
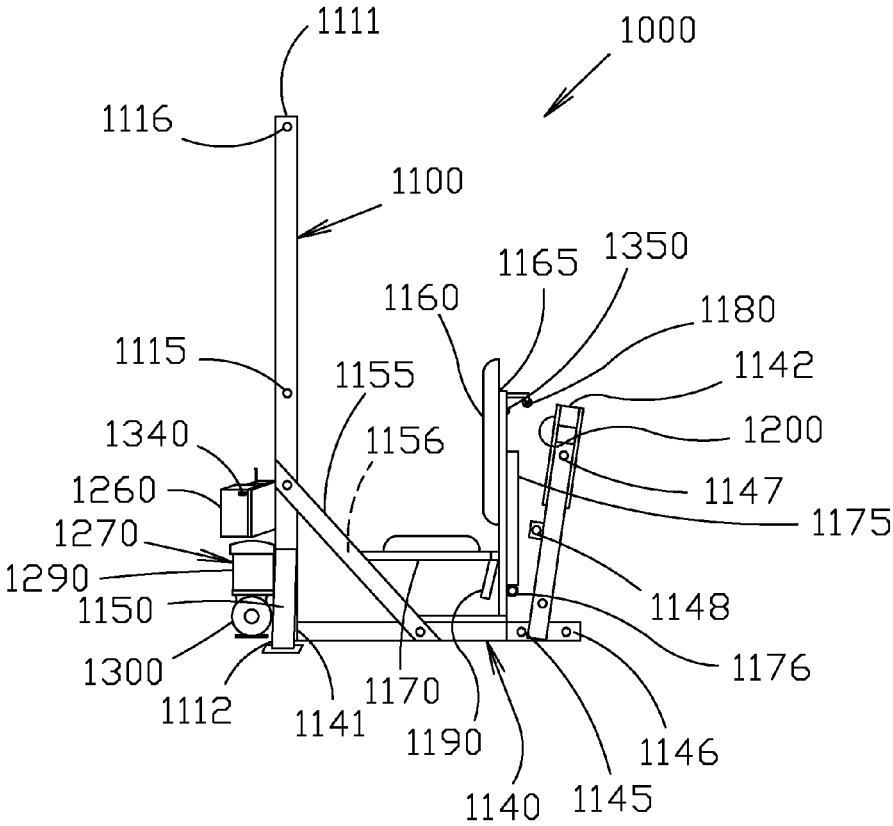
FIG. 19 is a side plan view of a preferred embodiment with the horizontal portion of the frame folded up for ease of storage.

FIGS. 181A and 18B are side views of a user performing a row exercise. Spool line 1321 is threaded through a guide post 1115 on the vertical section 1110 of the frame. The seat assembly 1160 is adjusted to tilt back at approximately a 45 degree angle. First, the vertical locking arm 1170 is unlocked or disengaged from the longitudinal gusset. The angled locking arm 1175 is then released and engaged or attached with bracket 1148 with a hitch pin to lock the arm to the bracket. The user is held in place on the seat assembly by a belt strap 1190. FIG. 18A shows the user at the start of a concentric contraction or the end of an eccentric contraction. FIG. 18B shows the user at the end of a concentric contraction or the start of an eccentric contraction.

Those skilled in the art, in light of the present teachings, will readily recognize that a multiplicity of alternate exercises may be performed on this device from both vertical and horizontal orientations of the spool line 1321 in accordance with preferred embodiments of the present invention such as, but not limited to, squats, dead-lifts, lateral raises, curls, calf raises, bench presses (flat, incline, and decline), dips, presses, rows, crunches, pull-downs, triceps push-downs, etc. Further, both vertical and horizontal oriented exercises performed on the device are wheelchair and paraplegic accessible (upon removal of the seat section 1160).

Figure 20:
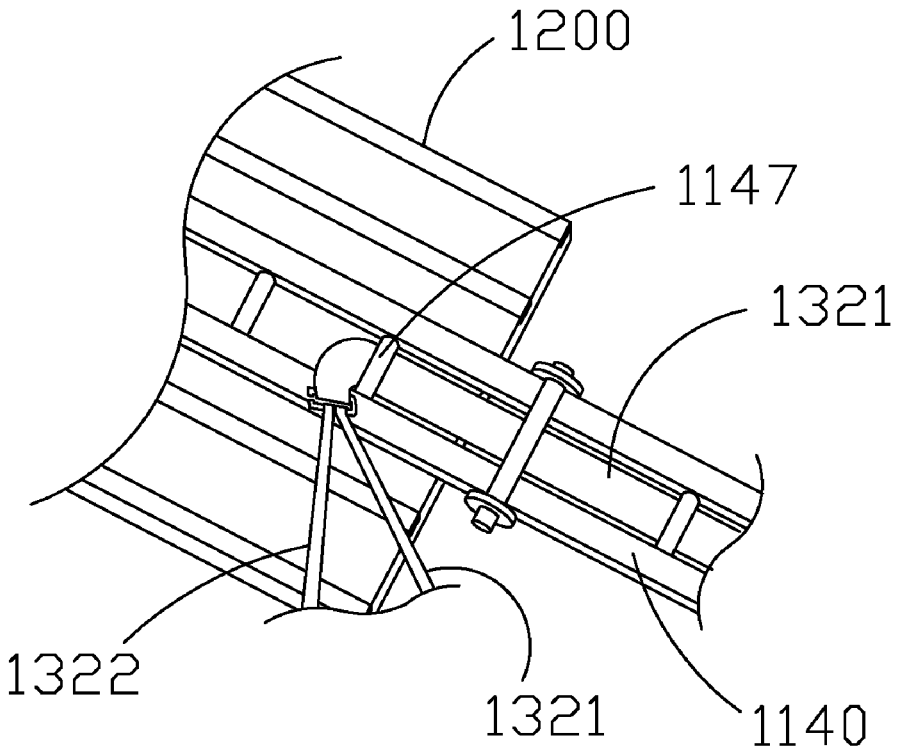
FIG. 20 is a perspective view showing a preferred embodiment of the spool line and a guide post at or near the foot plate.

FIG. 20 is a side view of the preferred embodiment of the exercise machine 1000 with a portion of the horizontal section 1140 of the frame 1100 folded upward in a vertical position for storage purposes. The horizontal portion is folded up and locking shafts are inserted to hold the horizontal portion in place in the storage position. Hitch pins are inserted through ends of locking shafts to ensure the horizontal portion remains safely in the upright position while in the stored mode.

Having fully described at least one embodiment of the present invention, other equivalent or alternative methods of providing an exercise or rehabilitation machine that enables the user to produce their maximum (0 to 100%) potential force while performing concentric, static, and eccentric muscular contractions according to the present invention will be apparent to those skilled in the art. The invention has been described by way of summary, detailed description and illustration. The specific embodiments disclosed in the above drawings are not intended to be limiting. For example, the particular implementation of the frame for any variety of exercise will vary depending on the choice of location from which the spool line is guided through. The configuration of the frame in the current embodiment are horizontal and vertical portions that are straight and perpendicular to the other but may also be embodied in alternative forms such as but not limited angled inclines, curvatures or comparatively disproportioned in length. Implementations of the present invention with various different configurations are contemplated as within the scope of the present invention. The invention is thus to cover all modifications, equivalents, and alternatives falling within the spirit and scope of the following claims.

It is appreciated that in an alternative embodiment, a control can be embedded in a separate structure for operation by another person such as a therapist or trainer.

Thus it is apparent that there has been provided, in accordance with the invention, a user controlled exercise machine that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. An exercise machine allowing a user to apply a user force upon said exercise machine to perform an exercise, said exercise machine comprising:

a frame comprising a first portion and a second portion, said first portion being positioned in a plane generally perpendicular to said first portion wherein said first portion is a vertical section and said second portion is a horizontal section, said vertical section being in a fixed relationship with said horizontal section, said frame further comprising a longitudinal gusset between said vertical section and said horizontal section;

a handle assembly selectably positionable at points relative said frame;

a drive assembly, said drive assembly being activated by said handle assembly.

2. The exercise machine of claim 1 further comprising a seat section, said seat section comprising a load support arm pivotally connected to said horizontal section.

3. The exercise machine of claim 2 wherein said seat section further comprises:

a vertical locking arm; and an angled locking arm, wherein said vertical locking arm is selectably attached to said longitudinal gusset to secure said load support arm in a vertical orientation.

4. The exercise machine of claim 3 wherein said vertical locking arm is rigidly connected to said load support arm.

5. The exercise machine of claim 4 wherein when said vertical locking arm is disengaged from said longitudinal gusset, said angled locking arm selectably engages said horizontal section of said frame to secure said seat section in an angled orientation.

6. The exercise machine of claim 1 wherein said drive assembly further comprises a spool assembly.

7. The exercise machine of claim 6 wherein said spool assembly comprises a line, said line being selectably positionable on either of said vertical section or said horizontal section.

8. The exercise machine of claim 7 wherein said line of said spool assembly is a continuous line, and said drive assembly further comprises:

an electric motor; and a gear box.

9. The exercise machine of claim 8 wherein said drive assembly further comprises a force transducer.

10. The exercise machine of claim 7 wherein said handle assembly comprises a bar, a button and a control, said button being able to activate said control to send a signal to activate said drive assembly to cause said spool assembly to selectably wind and unwind.

11. The exercise machine of claim 10 wherein said handle assembly wirelessly communicates with said drive assembly.

12. An exercise machine allowing a user to apply a user force upon said exercise machine to perform an exercise, said exercise machine comprising:

a frame comprising a vertical section and a horizontal section;

a handle assembly selectably positionable at points relative said frame;

a drive assembly, said drive assembly being activated by said handle assembly and comprising a spool assembly having a line that selectably winds and unwinds from said spool assembly, wherein said line is selectably positionable on either one of said vertical section or said horizontal section to allow a user to perform an exercise with resistance from one said vertical section or said horizontal section, said resistance being from said vertical section when said line is positioned on said vertical section and said resistance being from said horizontal section when said line is positioned on said horizontal section.

13. The exercise machine of claim 12 wherein:

said vertical section has a plurality of vertical section guide posts; and said horizontal section has a plurality of horizontal section guide posts.

14. The exercise machine of claim 12 wherein said frame further comprises a seat section, said seat section comprising:

a load supporting arm;

a vertical locking arm rigidly connected to said load support arm; and an angled locking arm pivotally connected to said load support arm.

15. The exercise machine of claim 12 wherein said handle assembly wirelessly communicates with said drive assembly wherein operation of said handle assembly is uncompromised by the location of said handle assembly relative said frame.

16. An exercise machine allowing a user to apply a user force upon said exercise machine to perform an exercise, said exercise machine comprising:

a frame comprising a vertical section, a horizontal section, a longitudinal gusset between said vertical section and said horizontal section and a seat section, said seat section comprising:

a load supporting arm pivotally connected to said horizontal section;

a vertical locking arm rigidly connected to said load supporting arm and removably connectable to said longitudinal gusset to secure said load support arm in a vertical orientation when said load supporting arm is in a first position, said vertical locking arm being disconnected from said longitudinal gusset to move said load supporting arm from said first position;

an angled locking arm pivotally connected to said load support arm and removably connectable to said horizontal section to secure said load supporting arm in an angled orientation when said exercise machine is in a second position, said angled locking arm being disconnected from said horizontal section to move said load supporting arm from said second position;

a handle assembly selectably positionable at points relative said frame; and a drive assembly, said drive assembly being activated by said handle assembly.

17. The exercise machine of claim 16 wherein said drive assembly comprises a spool assembly having a line that selectably winds and unwinds from said spool assembly, wherein said line is selectably positionable on either of said vertical section or said horizontal section to allow a user to perform an exercise with resistance from either said vertical section or said horizontal section.

18. The exercise machine of claim 17 wherein:

said handle assembly is a first handle assembly wherein said first handle assembly has a first handle controller for causing said spool assembly to selectably unwind; and said exercise machine comprises a second handle assembly with a second handle controller for causing said spool assembly to selectably wind.

* * * * *